US006308436B1

(12) United States Patent
Stipp

(10) Patent No.: US 6,308,436 B1
(45) Date of Patent: Oct. 30, 2001

(54) PROCESS FOR REMOVING WATER FROM FIBROUS WEB USING OSCILLATORY FLOW-REVERSING AIR OR GAS

(75) Inventor: Gordon Keith Stipp, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/108,844

(22) Filed: Jul. 1, 1998

(51) Int. Cl.[7] ..... F26B 7/00

(52) U.S. Cl. ..... 34/422; 34/444; 34/486; 34/488

(58) Field of Search ..... 34/245, 402, 414, 34/422, 444, 486, 488, 489; 162/206, 207, 359.1, 290, 375; 347/12, 13, 33, 44, 55; 28/103, 104, 105, 106; 431/1

(56) References Cited

U.S. PATENT DOCUMENTS

| | | |
|---|---|---|
| 2,515,644 | 7/1950 | Goddard . |
| 3,332,236 | 7/1967 | Kunsagi . |
| 3,418,723 | 12/1968 | Burgess et al. . |
| 3,541,697 | 11/1970 | Villalobos . |
| 3,650,295 | 3/1972 | Smith . |

(List continued on next page.)

FOREIGN PATENT DOCUMENTS

| | | |
|---|---|---|
| 54074414A | 6/1997 | (JP) . |
| WO 97/48853 | 12/1997 | (WO) . |

OTHER PUBLICATIONS

Eibeck et al., Pulse Combustion: Impinging Jet Heat Transfer Enhancement, *Combust. Sci. and Tech.,* 1993, vol. 1994, pp. 147–165.

Corliss, Heat–Transfer Enchancement By Pulse Combustion In Industrial Process, Proc. 1986 Symp. On Ind. Combustion Tech–Chic., p. 39–48, 1986.

Nomura et al., Heat and Mass Transfer Characteristics of Pulse–Combustion Drying Process, Dryiing '89 Ed. A Mujumdar, pp. 543–549, 1989.

Azevedo et al., Pulsed Air Jet Impingement Heat Transfer, Experimental Thermal and Fluid Science, 1994; 8:206–213.

Cui et al., Drying of Paper–A Summary of Recent Developments, Drying '84, Ed. A. Mujumdar, pp. 292–295, 1984.

(List continued on next page.)

*Primary Examiner*—Stephen Gravini
(74) *Attorney, Agent, or Firm*—Vladimir Vitenberg; Larry L. Huston; Donald E. Hasse

(57) ABSTRACT

A process and an apparatus for removing water from a fibrous web are disclosed. The process comprises providing a fibrous web having a moisture content from about 10% to about 90%; providing an oscillatory flow-reversing impingement gas having frequency of from 15 Hz to 1500 Hz; providing a gas-distributing system comprising a plurality of discharge outlets designed to emit the oscillatory flow-reversing impingement gas onto the web; and impinging the oscillatory flow-reversing gas onto the web through the plurality of discharge outlets, thereby removing moisture from the web. The apparatus comprises a web support designed to receive a fibrous web thereon and to carry it in a machine direction; at least one pulse generator designed to produce oscillatory flow-reversing air or gas; and at least one gas-distributing system in fluid communication with the pulse generator for delivering the oscillatory flow-reversing air or gas to the web. The gas-distributing system terminates with a plurality of discharge outlets juxtaposed with the web support such that the web support and the discharge outlets form an impingement distance therebetween, the plurality of the discharge outlets comprising a predetermined pattern defining an impingement area of the web.

22 Claims, 12 Drawing Sheets

U.S. PATENT DOCUMENTS

| | | | | |
|---|---|---|---|---|
| 3,665,962 | | 5/1972 | Dornseiffen . | |
| 3,668,785 | | 6/1972 | Rodwin . | |
| 3,694,926 | | 10/1972 | Rodwin et al. . | |
| 3,750,306 | | 8/1973 | Rodwin et al. . | |
| 3,838,000 | * | 9/1974 | Urbas | 34/422 X |
| 4,121,311 | * | 10/1978 | Meyer | 34/488 X |
| 4,517,915 | | 5/1985 | Olsson et al. . | |
| 4,635,571 | | 1/1987 | Olsson et al. . | |
| 4,697,358 | | 10/1987 | Kitchen . | |
| 4,708,159 | | 11/1987 | Lockwood . | |
| 4,834,288 | | 5/1989 | Kenny et al. . | |
| 4,942,675 | | 7/1990 | Sundqvist . | |
| 5,059,404 | | 10/1991 | Mansour et al. . | |
| 5,205,728 | | 4/1993 | Mansour . | |
| 5,211,704 | | 5/1993 | Mansour . | |
| 5,252,061 | | 10/1993 | Ozer et al. . | |
| 5,350,887 | | 9/1994 | Sandström . | |
| 5,355,595 | | 10/1994 | Kojvukunnas et al. . | |
| 5,548,907 | * | 8/1996 | Gourdine | 34/488 X |
| 5,588,223 | * | 12/1996 | Marshall | 34/444 X |
| 5,599,229 | | 2/1997 | Claunch et al. . | |
| 5,689,900 | | 11/1997 | Takayama et al. . | |
| 5,803,948 | | 9/1998 | Sizov et al. . | |
| 5,822,833 | | 10/1998 | James et al. . | |
| 5,865,955 | | 2/1999 | Ilvespää et al. . | |
| 5,913,329 | | 6/1999 | Haynes et al. . | |
| 5,915,813 | | 6/1999 | Joiner . | |
| 5,954,092 | | 9/1999 | Kroutil et al. . | |

OTHER PUBLICATIONS

Patterson, An Apparatus for the Evaluation of Web–Heating Technologies—Development, Capabilities, Preliminary Results, and Potential Uses, TAPPI Journal, vol. 79, No. 3, pp. 269–278, 1996.

Infrafone, Energy Saving with New Technology—infrasound, various pages.

Putnam et al., Pulse Combustion, Prop. Energy Combust. Sci., 1986, vol. 12, pp. 43–79.

Hanby, Convective Heat Transfer in a Gas–Fired Pulsating Combustor, J of Eng., vol. 1, p. 48–51, 1969.

Enkvist et al., The Valmet High Velocity and Temperature Yankee Hood on Tissue Machines, Valmet Technology Days '97, pp. 1–10.

Dec et al., Pulse Combustor Tail–Pipe Heat–Transfer Dependence on Frequency, Amplitude, and Mean Flow Rate, Sandia National Laboratories Report, pp. 1–32, Oct. 1988.

Keller et al., Pulse Combustion: Tailpipe Exit Jet Characteristics, Combust. Sci. and Tech. 1993, vol. 94, pp. 167–192.

Infrafone, *Infrafone Sonic Cleaning Systems for Exhaust Gas Boilers and Catalysts in Marine Diesel Engine Installations*, Mar., 1997.

Rounds et al., *Drying Rate and Energy Consumption for an Air Cap® Dryer System*, pp. 185–191, 1978.

T–type burners made by Manufacturing Technology and Conversion, Inc. of Baltimore, Maryland described in DOE/MC/25010–5004 (DE96000609), Aug., 1994.

Chapter 7, pp. 285–88 of Sonics—Techniques For The Use Of Sound And Ultrasound in Engineering And Science, T. Hueter and R. Bolt, 1955, John Wiley & Sons, Inc., New York.

* cited by examiner

PROCESS FOR REMOVING WATER FROM FIBROUS WEB USING OSCILLATORY FLOW-REVERSING AIR OR GAS

FIELD OF THE INVENTION

The present invention is related to processes for making strong, soft, absorbent fibrous webs. More particularly, the present invention is concerned with dewatering of fibrous webs.

BACKGROUND OF THE INVENTION

Fibrous structures, such as paper webs, are produced by a variety of processes. For example, paper webs may be produced according to commonly-assigned U.S. Pat. Nos. 5,556,509, issued Sep. 17, 1996 to Trokhan et al.; 5,580,423, issued Dec. 3, 1996 to Ampulski et al.; 5,609,725, issued Mar. 11, 1997 to Phan; 5,629,052, issued May 13, 1997 to Trokhan et al.; 5,637,194, issued Jun. 10, 1997 to Ampulski et al.; and 5,674,663, issued Oct. 7, 1997 to McFarland et al., the disclosures of which are incorporated herein by reference. Paper webs may also be made using through-air drying processes as described in commonly-assigned U.S. Pat. Nos. 4,514,345, issued Apr. 30, 1985 to Johnson et al.; 4,528,239, issued Jul. 9, 1985 to Trokhan; 4,529,480, issued Jul. 16, 1985 to Trokhan; 4,637,859, issued Jan. 20, 1987 to Trokhan; and 5,334,289, issued Aug. 2, 1994 to Trokhan et al. The disclosures of the foregoing patents are incorporated herein by reference.

Removal of water from the paper in the course of papermaking processes typically involves several steps. Initially, an aqueous dispersion of fibers typically contains more than 99% water and less than 1% papermaking fibers. Almost 99% of this water is removed mechanically, yielding a fiber-consistency of about 20%. Then, pressing and/or thermal operations, and/or through-air-drying, or any combination thereof, typically remove less than about 1% of the water, increasing the fiber-consistency of the web to about 60%. Finally, the remaining water is removed in the final drying operation (typically using a drying cylinder), thereby increasing the fiber-consistency of the web to about 95%.

Because of such a great amount of water needed to be removed, water removal is one of the most energy-intensive unit operations in industrial paper-making processes. According to one study, paper-making is the leading industry in total energy consumption for drying, using more than $3.75\times10^{14}$ BTU in 1985 (Salama et al., Competitive Position Of Natural Gas: Industrial Solids Drying, *Energy and Environmental Analysis, Inc.*, 1987). Therefore, more efficient methods of water removal in the paper-making processes may provide significant benefits for the paper-making industry, such as increased machine capacity and reduced operational costs.

It is known in the papermaking arts to use steady-flow impingement gas and cylinder dryers to dry a paper web. (See, for example, Polat et al., Drying Of Pulp And Paper, *Handbook Of Industrial Drying*, 1987, pp. 643–82). Typically, impingement hoods are used together with Yankee cylinder dryers for tissue products. In webs having relatively low basis weights of about 8–11 pounds per 3000 square feet, water is removed in about 0.5 seconds. This corresponds to an evaporation rate of about 42 pounds per hour per square feet, with about 75% of the total evaporation being performed by the impingement hood. The drying rates of paper products having relatively heavier basis weights are considerably slower. For example, newsprint, having a basis weight of about 30 pounds per 3000 square feet, has the evaporation rate of about 5 pounds per hour per square feet on the cylinder dryers. See, for example, P. Enkvist et al., *The Valmet High Velocity and Temperature Yankee Hood on Tissue Machines*, presented at Valmet Technology Days '97, Jun. 12–13, 1997, at Oshkosh, Wis., USA.

It is also known to use a sonic energy, such as that generated by steam jet whistles, to facilitate removal of water from various products, including paper. U.S. Pat. No. 3,668,785, issued to Rodwin on Jun. 13, 1972, teaches sonic drying and impingement flow drying in combination for drying a paper web. U.S. Pat. No. 3,694,926, issued to Rodwin et al. on Oct. 3, 1972, teaches a paper dryer having a sonic drying section through which the web is passed and subjected to high intensity noise from grouped noise generators, to dislocate moisture from the web. U.S. Pat. No. 3,750,306, issued to Rodwin et al. on Aug. 7, 1973, teaches sonic drying of webs and rolls, involving steam jet whistles spaced along trough-like reflectors and low pressure secondary air to sweep displaced moisture clear of the traveling web.

The foregoing teachings provide a means for generating sonic/acoustic energy and a separate means for generating steady-flow impingement/wiping air. Generating the acoustic energy in accordance with the prior art by such means as noise generators, steam whistles, and the like requires very powerful acoustic sources and leads to a significant power consumption. It is well known in the art that the efficiency of the conventional noise generators, such as sirens, horns, steam whistles, and the like typically do not exceed 10–25%. An additional equipment, such as auxiliary compressors to pressurize air, and amplifiers to generate the desired sound pressure, may also be necessary to reach a desired drying effect.

Now, it has been found that impingement of a paper web with air or gas having oscillatory flow-reversing movement, as opposed to a steady-flow impingement of the prior art, may provide significant benefits, including higher drying/dewatering rates and energy savings. It is believed that an oscillatory flow-reversing impingement air or gas having relatively low frequencies is an effective means for increasing, relative to the prior art, heat and mass transfer rates in papermaking processes.

Pulse combustion technology is a known and viable commercial method of enhancing heat and mass transfer in thermal processes. Commercial applications include industrial and home heating systems, boilers, coal gassification, spray drying, and hazardous waste incineration. For example, the following U.S. Patents disclose several industrial applications of pulse combustion: 5,059,404, issued Oct. 22, 1991 to Mansour et al.; 5,133,297, issued Jul. 28, 1992 to Mansour; 5,197,399, issued Mar. 30, 1993 to Mansour; 5,205,728, issued Apr. 27, 1993 to Mansour; 5,211,704, issued May 18, 1993 to Mansour; 5,255,634, issued Oct. 26, 1993 to Mansour; 5,306,481, issued Apr. 26, 1994 to Mansour et al.; 5,353,721, issued Oct. 11, 1994 to Mansour et al.; and 5,366,371, issued Nov. 22, 1994 to Mansour et al., the disclosures of which patents are incorporated by reference herein for the purpose of describing pulse combustion. An article entitled "Pulse Combustion: Impinging Jet Heat Transfer Enhancement" by P. A. Eibeck et al, and published in *Combustion Science and Technology*, 1993, Vol. 94, pp. 147–165, describes a method of convective heat transfer enhancement, involving the use of pulse combustor to generate a transient jet that impinges on a flat plate. The article reports enhancements in convective heat transfer of a factor of up to 2.5 compared to a steady-flow impingement.

The applicant believes that the oscillatory flow-reversing impingement can also provide significant increase in heat and mass transfer in web-dewatering and/or drying processes, relative to the prior art dewatering and/or drying processes. In particular, it is believed that the oscillatory flow-reversing impingement can provide significant benefits with respect to increasing paper machine rates, and/or reducing air flow needs for drying a web, thereby decreasing size of the equipment and capital costs of web-drying/dewatering operations and—consequently—an entire papermaking process. In addition, it is believed that the oscillatory flow-reversing impingement enables one to achieve a substantially uniform drying of the differential-density webs produced by the current assignee and referred to herein above. It is now also believed that the oscillatory flow-reversing impingement may be successfully applied to dewatering and/or drying of fibrous webs, alone or in combination with other water-removing processes, such as through-air drying, steady-flow impingement drying, and drying-cylinder drying.

To be able to effectively remove water from the web, the oscillatory flow-reversing air or gas should in most cases act upon the web in a substantially uniform manner, especially across the web's width (i.e., in a cross-machine direction). Alternatively, one might desire to differentiate, in a particular pre-determined manner, the application of the oscillatory impingement gas across the width of the web, thereby controlling relative moisture content and/or drying rates of differential regions of the web. In either instance, the control over the distribution of the oscillatory flow-reversing air or gas throughout the surface of the web, and particularly in the cross-machine-direction, is crucial to the effectiveness of the process of removing water from the web.

Paper webs produced on modern day's industrial-scale paper machines have width of about from 100 to 400 inches, and travel at linear velocities of up to 7,000 feet per minute. Such a width, coupled with a high-speed movement of the web creates certain difficulties of controlling (presumably uniform) distribution of the oscillatory gas throughout the surface of the web. Existing apparatuses for generating oscillatory flow-reversing air or gas, such as, for example, pulse combustors, are not well adapted, if at all, to generate a required substantially uniform oscillatory field of the flow-reversing air or gas across a relatively large area.

Accordingly, it is an object of the present invention to provide a process and an apparatus for removing water from fibrous webs, using the oscillatory flow-reversing impingement gas. It is another object of the present invention to provide a gas-distributing system allowing one to effectively control the distribution of the oscillatory flow-reversing air or gas throughout the surface of the web. It is still another object of the present invention to provide a gas-distributing system that creates a substantially uniform application of the oscillatory flow-reversing air or gas onto the web.

SUMMARY OF THE INVENTION

The present invention provides a novel process and an apparatus for removing water from a fibrous web by using oscillatory flow-reversing air or gas as an impinging medium. The apparatus and the process of the present invention may be used at various stages of the overall papermaking process, from a stage of forming an embryonic web to a stage of post-drying. Therefore, the fibrous web may have a starting moisture content in a broad range, from about 10% to about 90%, i.e., a fiber-consistency of the web may be from about 90% to about 10%.

In its process aspect, the present invention comprises the following steps: providing a fibrous web; providing an oscillatory flow-reversing impingement gas having a predetermined frequency, preferably in the range of from 15 Hz to 1500 Hz; providing a gas-distributing system comprising a plurality of discharge outlets and designed to deliver the oscillatory flow-reversing impingement gas onto a predetermined portion of the web; and impinging the oscillatory flow-reversing gas onto the web through the plurality of discharge outlets, thereby removing moisture from the web. Preferably, the oscillatory flow-reversing gas is impinged onto the web in a predetermined pattern defining an impingement area of the web.

The first step of providing a fibrous web may be preceded by steps of forming such a web, including the steps of providing a plurality of papermaking fibers. The present invention also contemplates the use of the web formed by dry-air-laid processes or the web that has been rewetted. The web may have a non-uniform moisture distribution prior to water removal by the process and the apparatus of the present invention, i.e., the fiber-consistency of some portions of the web may be different from the fiber-consistency of the other portions of the web.

A water-removing apparatus of the present invention has a machine direction and a cross-machine direction perpendicular to the machine direction. The apparatus of the present invention comprises: a web support designed to receive a fibrous web thereon and to carry it in the machine direction; at least one pulse generator designed to produce oscillatory flow-reversing air or gas having frequency from about 15 Hz to about 1500 Hz; and at least one gas-distributing system in fluid communication with the pulse generator for delivering the oscillatory flow-reversing air or gas to a predetermined portion of the web. The gas-distributing system terminates with a plurality of discharge outlets juxtaposed with the web support (or with the web when the web is disposed on the web support). The web support and the discharge outlets form an impingement region therebetween. The impingement region is defined by an impingement distance "Z." The impingement distance Z is, in other words, a clearance between the discharge outlets and the web support. Preferably, the plurality of the discharge outlets comprises a predetermined pattern defining an impingement area "E" of the web. The oscillatory flow-reversing gas may be impinged onto the web to provide a substantially even distribution of the gas throughout the impingement area of the web. Alternatively, the oscillatory gas may be impinged onto the web to provide an uneven distribution of the gas throughout the impingement area of the web thereby allowing control of moisture profiles of the web.

According to the present invention, the pulse generator is a device which is designed to produce oscillatory flow-reversing air or gas having a cyclical velocity/momentum component and a mean velocity/momentum component. Preferably, an acoustic pressure generated by the pulse generator is converted to a cyclical movement of large amplitude, comprising negative cycles alternating with positive cycles, the positive cycles having greater momentum and cyclical velocity relative to the negative cycles, as will be described in greater detail below.

One preferred pulse generator comprises a pulse combustor, generally comprising a combustion chamber, an air inlet, a fuel inlet, and a resonance tube. The tube operates as a resonator generating standing acoustic waves. The resonance tube is in further fluid communication with a gas-distributing system. As used herein, the term "gas-distributing system" defines a combination of tubes, tailpipes, blow boxes, etc., designed to provide an enclosed path for the oscillatory flow-reversing air or gas produced by the pulse generator, and to deliver the oscillatory flow-reversing air or gas to a predetermined impingement region (defined herein above), where the oscillatory flow-reversing air or gas is impinged onto the web, thereby removing water therefrom. The gas-distributing system is designed such as to minimize, and preferably avoid altogether, disruptive interference which may adversely affect a desired mode of operation of the pulse combustor or oscillatory characteristics of the flow-reversing gas generated by the pulse combustor. The gas-distributing system delivers the flow-reversing impingement air or gas onto the web, preferably through a plurality of discharge outlets, or nozzles. The preferred frequency of the oscillatory flow-reversing impingement air or gas is in a range of from about 15 Hz to about 1500 Hz. The more preferred frequency is from 15 Hz to 500 Hz, and the most preferred frequency is from 15 Hz to 250 Hz, depending on a type of the pulse generator and/or desired characteristics of the water-removing process. If the pulse generator comprises the pulse combustor, the preferred frequency is from about 75 Hz to about 250 Hz. A Helmholtz-type resonator may be used in the pulse generator of the present invention. Typically, the Helmholtz-type pulse generator may be tuned to achieve a desired sound frequency. In the pulse combustor, the temperature of the oscillatory gas at the exit from the discharge outlets is from about 500° F. to about 2500° F.

Another embodiment of the pulse generator comprises an infrasonic device. The infrasonic device comprises a resonance chamber in fluid communication with an air inlet through a pulsator. The pulsator generates an oscillating air having infrasound (low frequency) pressure which then is amplified in the resonance chamber and in the resonance tube. The infrasonic device's preferred frequency of the oscillating flow-reversing air is from 15 Hz to 100 Hz. If desired, the apparatus comprising the infrasonic device may have a means for heating the oscillatory flow-reversing air generated by the infrasonic device.

The oscillatory flow-reversing impingement air or gas has two components: a mean component characterized by a mean velocity and a corresponding mean momentum; and an oscillatory, or cyclical, component characterized by a cyclical velocity and a corresponding cyclical momentum. The oscillatory cycles during which the combustion gas moves "forward" from the combustion chamber, and into, through, and from the gas-distributing system are positive cycles; and the oscillatory cycles during which a back-flow of the impingement gas occurs are negative cycles. An average amplitude of the positive cycles is a positive amplitude, and an average amplitude of the negative cycles is a negative amplitude. During the positive cycles, the impingement gas has a positive velocity directed in a positive direction towards the web disposed on the web support; and during the negative cycles, the impingement gas has a negative velocity directed in a negative direction. The positive direction is opposite to the negative direction, and the positive velocity is opposite to the negative velocity. The positive velocity component is greater than the negative velocity component, and the mean velocity has the positive direction.

The pulse combustor produces an intense acoustic pressure, typically in the order of 160–190 dB, inside the combustion chamber. This acoustic pressure reaches its maximum level in the combustion chamber. Due to the open end of the resonance tube, the acoustic pressure is reduced at the exit of the resonance tube. This drop in the acoustic pressure results in a progressive increase in cyclical velocity which reaches its maximum at the exit of the resonance tube. In the preferred Helmholtz-type pulse generator the acoustic pressure is minimal at the exit of the resonance tube—in order to achieve a maximal cyclical velocity in the exhaust flow of oscillatory impingement gases. The decreasing acoustic pressure beneficially reduces noise typically associated with sonically enhanced processes of the prior art.

At the exit of the gas-distributing system, the cyclical velocity, ranging from about 1,000 ft/min to about 50,000 ft/min, and preferably from about 2,500 ft/min to about 50,000 ft/min, is calculated based on the measured acoustic pressure in the combustion chamber. The more preferred cyclical velocity is from about 5,000 ft/min to about 50,000 ft/min. The mean velocity is from about 1,000 ft/min to about 25,000 ft/min, preferably from about 2,500 ft/min to about 25,000 ft/min, and more preferably from about 5,000 ft/min to about 25,000 ft/min.

It is believed that for the web having moisture content from about 10% to about 60%, the apparatus and the process of the present invention allow one to achieve the water-removal rates up to 150 $lb/ft^2 \cdot hr$ and higher. In order to achieve the desired water-removal rates, the oscillatory flow-reversing impingement gas should preferably form an oscillatory "flow field" substantially uniformly contacting the web throughout the surface of the web. One way of accomplishing it is to cause the flow of the oscillatory gas from the gas-distributing system be substantially equally split and impinged onto the drying surface of the web through a network of the discharge outlets. Therefore, the apparatus of the present invention is designed to discharge the oscillatory flow-reversing impingement air or gas onto the web according to a pre-determined, and preferably controllable, pattern. A pattern of distribution of the discharge outlets may vary. One preferred pattern of distribution comprises a non-random staggered array.

The discharge outlets of the gas-distributing system may have a variety of shapes, including but not limited to: a round shape, generally rectangular shape, an oblong slit-like shape, etc. Each of the discharge outlets has an open area "A" and an equivalent diameter "D." A resulting open area "ΣA" is a combined open area formed by all individual open areas of the discharge outlets together. An area of a portion of the web impinged upon by the oscillatory flow-reversing impingement field at any moment of the continuous process is the impingement area "E."

Preferably, the web is supported by the web support, more preferably traveling in the machine direction. In the preferred embodiment a means for controlling the impingement distance may be provided, such as, for example, conventional manual mechanisms, as well as automated devices, for causing the outlets of the gas-distributing system and the web support to move relative to each other, thereby changing the impingement distance. Prophetically, the impingement distance may be automatically adjustable in response to a signal from a control device, measuring at least one of the parameters of the dewatering process or one of the parameters of the web. In the preferred embodiment, the impingement distance may vary from about 0.25 inches to about 6.0 inches. The impingement distance defines an impingement region, i.e., the region between the discharge outlet(s) and the web support. In the preferred embodiment, a ratio of the impingement distance Z to the equivalent diameter D of the discharge outlet (i.e., Z/D) is from about 1.0 to about 10.0. A ratio of the resulting open area ΣA to the impingement area E (i.e., ΣA/E) is from 0.002 to 1.000, preferably from 0.005 to 0.200, and more preferably from 0.010 to 0.100.

In one embodiment, the gas-distributing system comprises at least one blow box. The blow box comprises a bottom plate having the plurality of the discharge outlets therethrough. The blow box may have a substantially planar bottom plate. Alternatively, the bottom plate of the blow box may have a non-planar or curved shape, such as, for example, a convex shape, or a concave shape. In one embodiment of the blow box, a generally convex bottom plate is formed by a plurality of sections.

An angled application of the oscillating flow-reversing air or gas may be beneficially used in the present invention. Angles formed between the general surface of the web support (or a surface of the impingement area E of the web) and the positive directions of the oscillating streams of air or gas through the discharge outlet may range from almost 0 degree to 90 degrees. These angles may be oriented in the machine direction, in the cross-machine direction, and in the direction intermediate the machine direction and the cross-machine direction.

A plurality of the gas distributing systems may be used across the width of the web. This arrangement allows a greater flexibility in controlling the conditions of the web-dewatering process across the width of the web. For example, such arrangement allows one to control the impingement distance individually for differential cross-machine directional portions of the web. If desired, the individual gas-distributing systems may be distributed throughout the surface of the web in a non-random, and preferably staggered-array, pattern.

The oscillatory field of the flow-reversing impingement gas may beneficially be used in combination with a steady-flow (non-oscillatory) impingement gas impinged onto the web. One preferred embodiment comprises sequentially-alternating application of the oscillatory flow-reversing gas and the steady-flow gas. One of or both the oscillatory gas and the steady-flow gas can comprise jet streams having the angled position relative to the web support.

The web support may include a variety of structures, for example, papermaking band or belt, wire or screen, a drying cylinder, etc. In the preferred embodiment, the web support travels in the machine direction at a velocity of from 100 feet per minute to 10,000 feet per minute. More preferably, the velocity of the web support is from 1,000 feet per minute to 10,000 feet per minute. The apparatus of the present invention may be applied in several principal steps of the overall papermaking process, such as, for example, forming, wet transfer, pre-drying, drying cylinder (such as Yankee) drying, and post-drying. One preferred location of the impingement region is an area formed between a drying cylinder and a drying hood juxtaposed with the drying cylinder, in which instance the web support may comprise a surface of the drying cylinder. In one embodiment, the impingement hood is located on the "wet end" of the cylinder dryer. The drying residence time can be controlled by the combination of hood wrap around the drying cylinder and machine speed. The process is particularly useful in the elimination of moisture gradients present in the differential-density structured paper webs.

One preferred embodiment of the web support comprises a fluid-permeable endless belt or band having a web-contacting surface and a backside surface opposite to the web-contacting surface. This type of web support preferably comprises a framework joined to a reinforcing structure, and at least one fluid-permeable deflection conduit extending between the web-contacting surface and the backside surface. The framework may comprise a substantially continuous structure. Alternatively or additionally, the framework may comprise a plurality of discrete protuberances. If the web-contacting surface is formed by a substantially continuous framework, the web-contacting surface comprises a substantially continuous network; and the at least one deflection conduit comprises a plurality of discrete conduits extending through the substantially continuous framework, each discrete conduit being encompassed by the framework.

Using the process and the apparatus of the present invention one can simultaneously remove moisture from differential density portions structured webs. The dewatering characteristics of the oscillatory flow-reversing process is dependent to a significantly lesser degree, if at all, upon the differences in density of the web being dewatered, in comparison with the prior art's conventional processes using a drying cylinder or through-air-drying processes. Therefore, the process of the present invention effectively decouples the water-removal characteristics of the dewatering process—most importantly water-removal rates—from the differences in the relative densities of the differential portions of the web being dewatered.

The process of the present invention, either alone or in combination with the through-air-drying, can eliminate the application of the drying cylinder as a step in the papermaking process. One of the preferred applications of the process of the present invention is in combination with through-air-drying, including application of pressure generated by, for example, a vacuum source. The apparatus of the present invention may be beneficially used in combination with a vacuum apparatus, such as, for example, a vacuum pick-up shoe or a vacuum box, in which instance the web support is preferably fluid-permeable. The vacuum apparatus is preferably juxtaposed with the backside surface of the web support, and more preferably in the area corresponding to the impingement region. The vacuum apparatus applies a pressure to the web through the fluid-permeable web support. In this instance, the oscillatory flow-reversing gas created by the pulse generator and the pressure created by the vacuum apparatus can beneficially work in cooperation, thereby significantly increasing the efficiency of the combined dewatering process, relative to each of those individual processes.

Optionally, the apparatus of the present invention may have an auxiliary means for removing moisture from the impingement region, including the boundary layer. Such an auxiliary means may comprise a plurality of slots in fluid communication with an outside area having the atmospheric pressure. Alternatively or additionally, the auxiliary means may comprise a vacuum source, and at least one vacuum slot extending from the impingement region and/or an area adjacent to the impingement region to the vacuum source, thereby providing fluid communication therebetween.

DETAILED DESCRIPTION OF THE INVENTION

The first step of the process of the present invention comprises providing a fibrous web. As used herein the term "fibrous web," or simply "web," 60 (FIGS. 1 and 6–9) designates a macroscopically planar substrate comprising cellulosic fibers, synthetic fibers, or any combination thereof. The web 60 may be made by any papermaking process known in the art, including, but not limited to, a conventional process and a through-air drying process. Suitable fibers comprising the web 60 may include recycled, or secondary, papermaking fibers, as well as virgin papermaking fibers. Such fibers may comprise hardwood fibers, softwood fibers, and non-wood fibers. As used herein, the term "fibrous web" includes tissue webs having basis weight of from about 8 pounds per 3000 square feet (lb/3000 $ft^2$) to about 20 lb/3000 $ft^2$, as well as board-grade webs having basis weight from about 25 lb/1000 $ft^2$ to about 100 lb/1000 $ft^2$, including but not limited to Kraft paper webs having basis weight in the order of from 30 to 80 lb/3000 $ft^2$, bleached paper boards having basis weight in the order of from 40 to 100 lb/1000 $ft^2$, and newsprint papers having typical basis weight is about 30 lb/3000 $ft^2$.

Figure 8:
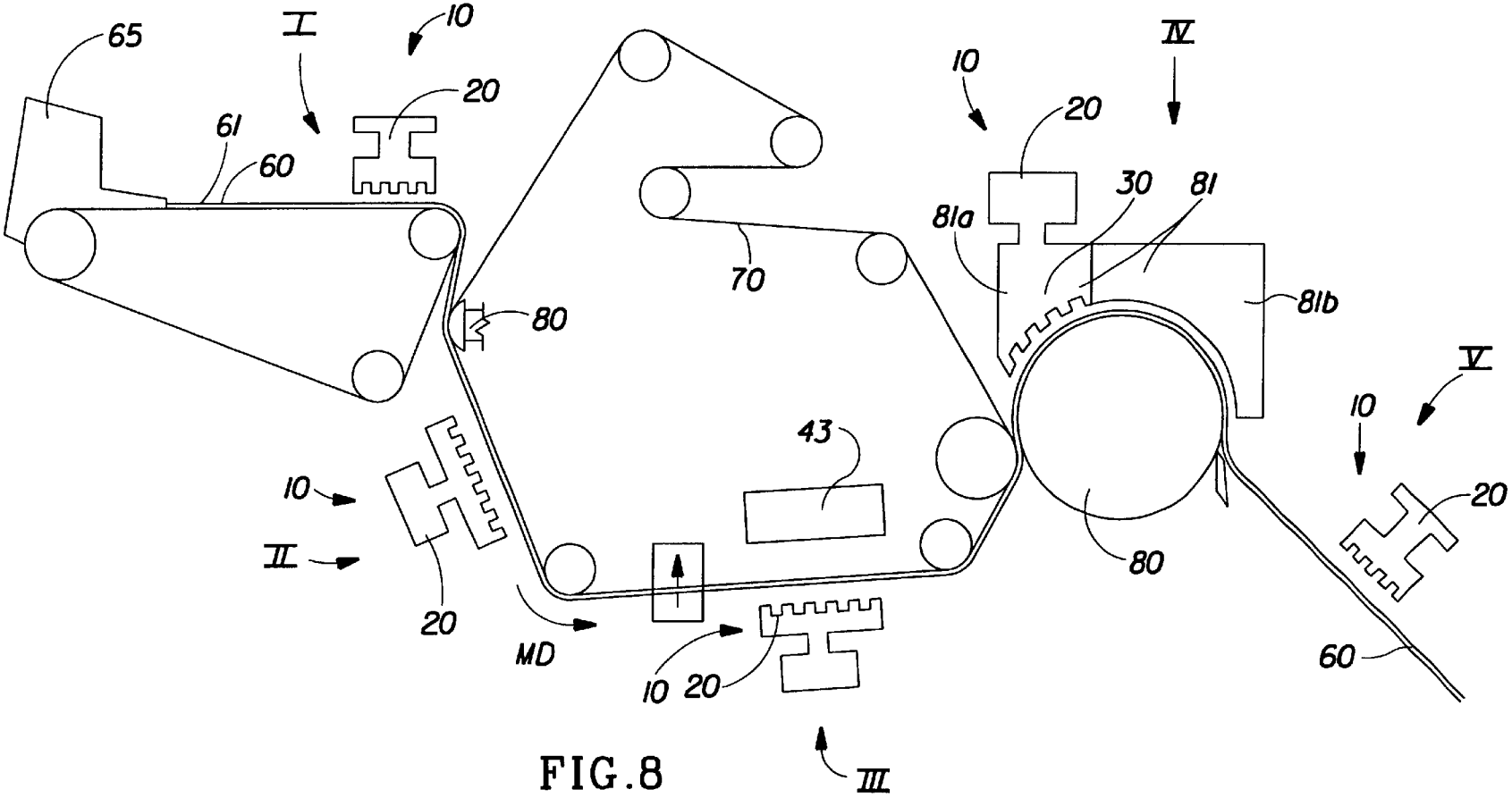
FIG. 8 is a schematic representation of a continuous papermaking process of the present invention, illustrating some of the possible locations of the apparatus of the present invention relative to the overall papermaking process.

The first step of providing a fibrous web 60 may be preceded by steps of forming such a web. One skilled in the art will readily recognize that forming the web 60 may include the steps of providing a plurality of fibers 61 (FIG. 8). In a typical continuous papermaking process, illustrated in FIG. 8, the plurality of fibers 61 are preferably suspended in a liquid carrier. More preferably, the plurality of fibers 61 comprises an aqueous dispersion. An equipment for preparing the aqueous dispersion of fibers 61 is well-known in the art and is therefore not shown in FIG. 8. The aqueous dispersion of fibers 61 may be provided to a headbox 65, as shown in FIG. 8. While a single headbox 65 is shown in FIG. 8, it is to be understood that there may be multiple headboxes in alternative arrangements of the process of the present invention. The headbox(es) and the equipment for preparing the aqueous dispersion of fibers are typically of the type disclosed in U.S. Pat. No. 3,994,771, issued to Morgan and Rich on Nov. 30, 1976, which patent is incorporated by reference herein. The preparation of the aqueous dispersion of the papermaking fibers and exemplary characteristics of such an aqueous dispersion are described in greater detail in U.S. Pat. No. 4,529,480, which patent is incorporated by reference herein. The present invention also contemplates the use of the web 60 formed by dry-air-laid processes. Such processes are described, for example, in S. Adanur, Paper Machine Clothing, *Technomic Publishing Co., Lancaster, Pa*., 1997, p. 138. The present invention also contemplates the use of the web 60 that has been rewetted. Rewetting of a previously-manufactured dry web may be used for creating three-dimensional web structures by, for example, embossing the rewetted web and than drying the embossed web. Also is contemplated in the present invention the use of a papermaking process disclosed in U.S. Pat. No. 5,656,132, issued on Aug. 12, 1997 to Farrington et al. and assigned to Kimberly-Clark Worldwide, Inc. of Neenah, Wis.

An apparatus 10 and the process of the present invention are useful at various stages of the overall papermaking process, from a stage of forming an embryonic web to a stage of post-drying, as shown in FIG. 8 and explained in greater detail below. Therefore, for the purposes of the present invention, the fibrous web 60 may have a fiber-consistency from about 10% to about 90%, or—to state it differently—the fibrous web 60 may have a moisture content from about 90% to about 10%. Of course, the parameters of the process and the apparatus 10 of the present invention may, and preferably should, be adjusted to suit the specific needs depending on the web's moisture content before dewatering/drying and a desired moisture content after such dewatering/drying, a desired rate of dewatering/drying, velocity of the web 60 in the preferred continuous process, residence time (i.e., the time during which a certain portion of the web 60 is acted upon by the flow-reversing impingement gas), and other relevant factors that will be discussed herein below. The web 60 may have a non-uniform moisture distribution prior to water removal by the process and the apparatus 10 of the present invention.

As used herein, the term "drying" means removal of water (or moisture) from the fibrous web 60 by vaporization. The vaporization involves a phase-change of the water from a liquid phase to a vapor phase, or steam. The term "dewatering" means removal of water from the web 60 without producing the phase-change in the water being removed. This distinction between the drying and dewatering is significant in the context of the present invention, because depending on a particular stage of the overall papermaking process (FIG. 8), one type of water removal may be more relevant than the other. For example, at the stage of an embryonic web formation, (FIG. 8, I and II), the bulk water is primarily removed by mechanical means. Thereafter, at stages of pressing and/or thermal operations and/or through-air-drying (FIG. 8, III and IV), vaporization is generally required to remove the water.

As used herein, the terms "removal of water" or "water removal" (or permutations thereof are generic and include both drying and dewatering, along or in combination. Analogously, the terms "water-removal rate(s)" or "rates of water removal" (and their permutations) refer to dewatering, drying, or any combination thereof. Similarly, the term "water-removing apparatus" applies to an apparatus of the present invention designed to remove water from the web 60 by drying, dewatering, or a combination thereof. A conjunctive-disjunctive combination "dewatering and/or drying" (or simply dewatering/drying) encompasses one of the following: dewatering, drying, or a combination of dewatering and drying, as defined herein.

The success of dewatering depends on the form of water present in the web 60. At the stage of web formation, the water may be present in the web 60 in several distinct forms: bulk (about 20% relative to the entire water-content), micropore (about 40%), colloidal bound (about 20%), and chemisorbed (about 10%). (H. Muralidhara et al., *Drying Technology*, 3(4), 1985, 529–66.) The bulk water can be removed via vacuum techniques. However, removal of the micropore water from the web 60 is more difficult than removal of the bulk water, because of the capillary forces formed between the papermaking fibers and the water, that must be overcome. Both the colloidal bound water and chemisorbed water cannot typically be removed from the web using conventional dewatering techniques, because of strong hydrogen bonding between the papermaking fibers and water, and must be removed by using thermal treatment. The apparatus and the process of the present invention is applicable to both the drying and the dewatering techniques of water-removal.

The apparatus 10 of the present invention comprises a pulse generator 20 in combination with a web support 70 designed to carry the web 60 in the proximity of the pulse generator 20 such that the web 60 is penetrable by the flow-reversing impingement gas generated by the pulse generated 20. As used herein, the term "pulse generator" refers to a device which is designed to produce oscillatory flow-reversing air or gas having a cyclical velocity/momentum component and a mean velocity/momentum component. Preferably, an acoustic pressure generated by the pulse generator 20 is converted to a cyclical movement of large amplitude, comprising negative cycles alternating with positive cycles, the positive cycles having greater momentum and cyclical velocity relative to the negative cycles, as will be described in greater detail below.

Figure 4:
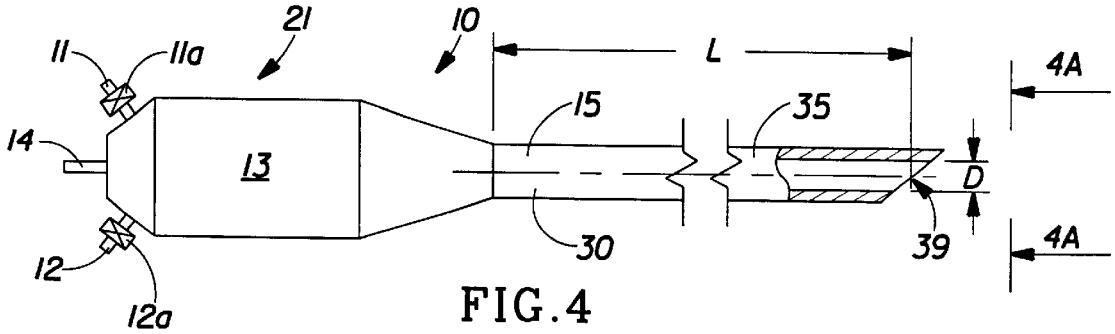
FIG. 4 is a schematic and simplified side elevational view of a pulse combustor which can be used in the apparatus and the process of the present invention.

One type of the pulse generator 20 that may be useful in the present invention comprises a sound generator and a tube, or tailpipe, of a substantially uniform diameter and having one end open to atmosphere and the other, opposite, end closed, a length L of the tube being measured between the tube's opposite ends (FIG. 4). The tube operates as a resonator generating standing acoustic waves. As well known in the art, the standing acoustic waves have an antinode (maximum velocity and minimum pressure) at the open end of the tube, and a node (minimum velocity and maximum pressure) at the closed end of the tube. Preferably, these standing waves satisfy the following condition: $L=\omega(2N+1)/4$, where L is the length of the tube; $\omega$ is the wavelength of the standing wave, and N is an integer (i.e., N=0,1,2,3, . . . , etc.).

A sound having wave length of one-forth of the resonator tube (i.e., $L=\omega/4$, and N=0) is typically defined in the art as a fundamental tone. Other sound waves are defined as a first harmonic (N=1), a second harmonic (N=2), a third harmonic (N=3), . . . , etc. In the present invention, the preferred resonator tube has a length that equals to one fourth (¼) of the frequency generated by the sound generator, i.e., the preferred pulse generator 20 generates acoustic waves of the fundamental tone, with N=0. The standing acoustic waves provide a varying air pressure in the resonator tailpipe with the largest pressure amplitude at the closed end of the tailpipe resonator. Sound frequency and wavelength are related according to the following equation: $F=C/\omega$, where F is the sound frequency, and C is the speed of sound. In the instance of the pulse generator 20 generating the fundamental tone, the relationship between frequency and wavelength can be described more specifically by the formula: $F=C/4L$, from the previously defined relations.

FIG. 4 shows one preferred pulse generator 20 comprising a pulse combustor 21. The pulse combustor 21, shown in FIG. 4, comprises a combustion chamber 13, an air inlet 11, a fuel inlet 12, and a resonance tube 15. As used herein, the term "resonance tube" 15 designates a portion of the pulse generator 20, which causes the combustion gases to longitudinally vibrate at a certain frequency while moving in a certain predetermined direction defined by geometry of the resonance tube 15. One skilled in the art will appreciate that resonance occurs when a frequency of a force applied to the resonance tube 15, i.e. the frequency of the combustion gas created in the combustion chamber 13, is equal to or close to the natural frequency of the resonance tube 15. To put it differently, the pulse generator 20, including the resonance tube 15, is designed such that the resonance tube 15 transforms the hot combustion gas produced in the combustion chamber 13 into oscillatory (i.e., vibrating) flow-reversing impingement gas.

In FIG. 4, the air inlet 11 and the fuel inlet 12 are in fluid communication with the combustion chamber 13 for delivering air and fuel, respectively, into the combustion chamber 13, where the fuel and air mix to form a combustible mixture. Preferably, the pulse combustor 21 also includes a detonator 14 for detonating a mixture of air and fuel in the combustion chamber 13. The pulse combustor 21 may also comprise an inlet air valve 11*a* and an inlet fuel valve 12*a*, for controlling delivery of the air and the fuel, respectively, as well as parameters of combustion cycles of the pulse combustor 21.

Figure 1:
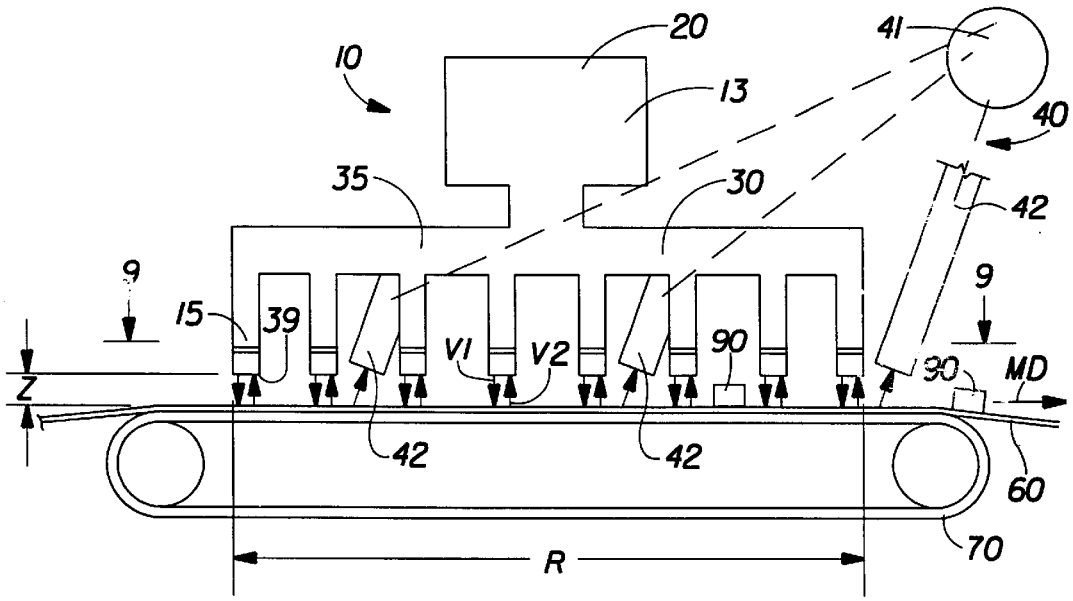
FIG. 1 is a schematic and simplified side elevational view of an apparatus and a preferred continuous process of the present invention, showing a pulse generator emitting oscillatory flow-reversing impingement air or gas onto a moving web supported by an endless belt or band.
Figure 9:
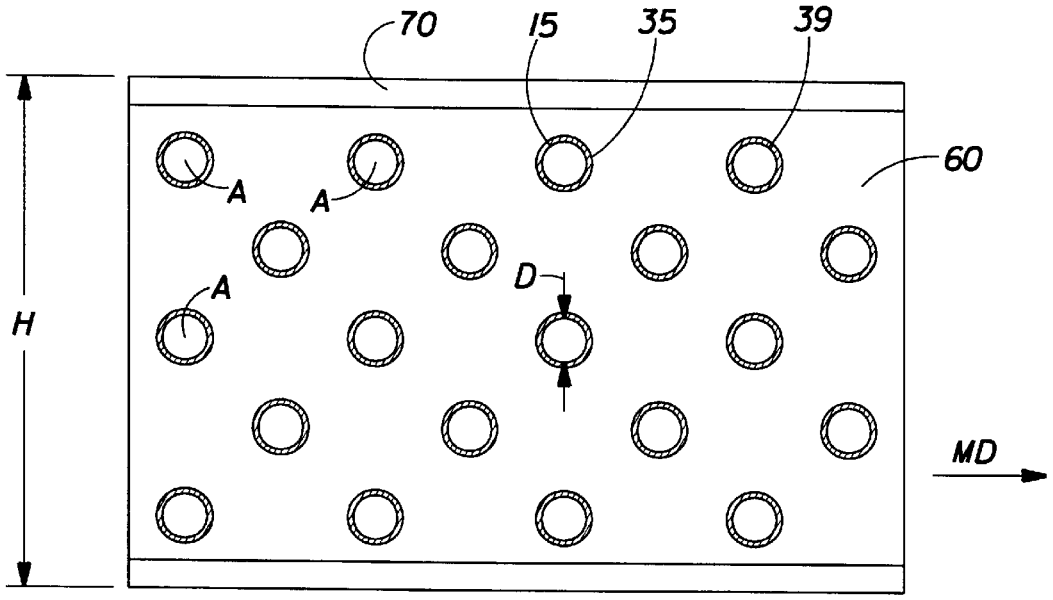
FIG. 9 is a schematic cross-sectional plan view taken along line 9—9 of FIG. 1, and showing one embodiment of a non-random pattern of the pulse generator's discharge outlets, relative to the surface of the web.

The resonance tube 15 is in further fluid communication with a gas-distributing system 30. As used herein, the term "gas-distributing system" defines a combination of tubes, tailpipes, boxes, etc., designed to provide an enclosed path for the oscillatory flow-reversing air or gas produced by the pulse generator 20, and thereby deliver the oscillatory flow-reversing air or gas into a pre-determined impingement region, where the oscillatory flow-reversing air or gas is impinged onto the web 60, thereby removing water therefrom. The gas-distributing system 30 is designed such as to minimize, and preferably avoid altogether, disruptive interference which may adversely affect a desired mode of operation of the pulse combustor 21 or oscillatory characteristics of the flow-reversing gas generated by the pulse combustor 21. One skilled in the art will appreciate that at least in some possible embodiments (FIGS. 1, 9, and 4) of the apparatus 10 of the present invention, the gas-distributing system 30 may comprise the resonance tube or tubes 15. In other words, in some instances the resonance tube 15 may comprise an inherent part of both the pulse combustor 21 and the gas-distributing system 30, as they both are defined herein. In such instances, a combination of the resonance tube(s) 15 and the gas-distributing system 30 is termed herein as "resonance gas-distributing system" and designated by the reference numeral 35. For example, the resonance gas-distributing system 35 may comprise a plurality of resonance tubes, or tailpipes, 15, as shown in FIGS. 4, 1 and 9. In this respect, the distinction between the "gas-distributing system 30" and the "resonance gas-distributing system 35" is rather formal, and the terms "gas-distributing system" and "resonance gas-distributing system" are in most instances interchangeable.

Regardless of its specific embodiment, the gas-distributing system 30, or the resonance gas-distributing system 35, delivers the flow-reversing impingement air or gas onto the web 60, preferably through a plurality of discharge outlets, or nozzles, 39. The preferred frequency F of the oscillatory flow-reversing impingement air or gas impinged upon the web 60 is in a range of from about 15 Hz to about 1500 Hz. The more preferred frequency F is from 15 Hz to 500 Hz, and the most preferred frequency F is from 15 Hz to 250 Hz. If the pulse generator 20 comprises the pulse combustor 21, the preferred frequency is from 75 Hz to 250 Hz.

A typical pulse combustor 21 operates in the following manner. After air and fuel enter the combustion chamber 13 and mix therein, the detonator 14 detonates the air-fuel mixture, thereby providing start-up of the pulse combustor 21. The combustion of the air-fuel mixture creates a sudden increase in volume inside the combustion chamber 13, triggered by a rapid increase in temperature of the combustion gas. As the hot combustion gas expands, the inlet valves 11*a* and 12*a* close, thereby causing the combustion gas to expand into a resonance tube 15 which is in fluid communication with the combustion chamber 13. In FIG. 4, the resonance tube 15 also comprises the gas-distributing system 30 and thus forms the resonance gas-distributing system 35, as explained herein above. The gas-distributing system 30 has at least one discharge outlet 39 having an open area, designated as "A" in FIGS. 4A and 4B, through which open area A the hot oscillatory gas exits the gas-distributing system 30 (FIG. 4).

One skilled in the art will appreciate that FIG. 4 illustrates one type of the pulse combustor 21 that can be used in the present invention. A variety of pulse combustors is known in the art. Examples include, but are not limited to: gas pulse combustors commercially available from The Fulton® Companies of Pulaski, New York; pulse dryers made by J. Jireh Corporation of San Rafael, California; and Cello® burners made by Sonotech, Inc. of Atlanta, Ga.

Figure 20:
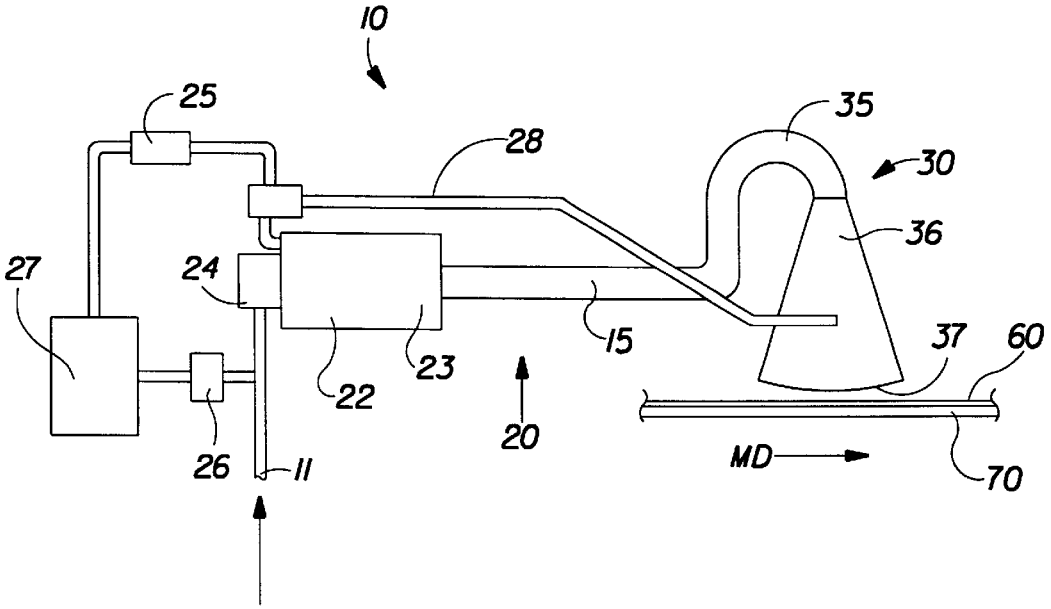
FIG. 20 is a schematic representation of an embodiment of the pulse generator useful in the present invention, comprising an infrasonic device.

FIG. 20 shows another embodiment of the pulse generator 20, comprising an infrasonic device 22. The infrasonic device 22 comprises a resonance chamber 23 which is in fluid communication with an air inlet 11 through a pulsator 24. The pulsator 24 generates an oscillating air having infrasound (low frequency) pressure which then is amplified in the resonance chamber 23 and in the resonance tube 15. The infrasonic device 22, shown in FIG. 20, further comprises a pressure-equalizing hose 28 for equalizing air pressure between the pulsator 24 and the diffuser 26, a transducer box 25 and an insonating controller 27 for controlling the frequency of pulsations. Various valves may also be used in the infrasonic device 22, for example a valve 26 controlling fluid communication between the insonating controller 27 and the air inlet 11. If the pulse generator 20 comprises the infrasonic device 22, the preferred frequency of the oscillating flow-reversing air is from 15 Hz to 100 Hz. The infrasonic device 22 schematically shown in FIG. 20 is commercially made under the name INFRAFONE® by Infrafone AB Company of Sweden. Low-frequency sound generators are described in U.S. Pat. No. 4,517,915, issued May 21, 1985, to Olsson, et al; U.S. Pat. No. 4,650,413, issued Mar. 17, 1987, to Olsson, et al; U.S. Pat. No. 4,635,571, issued Jun. 13, 1987, to Oisson, et al; U.S. Pat. No. 4,592,293, issued Jun. 3, 1986, to Olsson, et al; U.S. Pat. No. 4,721,395, issued Jan. 26, 1988, to Olsson, et al; U.S. Pat. No. 5,350,887, issued Sep. 27, 1994, to Sandström, the disclosures of which patents are incorporated herein by reference for the purpose of describing an apparatus for generating low-frequency oscillations.

The apparatus 10 comprising the infrasonic device 22 may have a means (not shown) for heating the oscillatory air discharged by the infrasonic device 22. Such means, if desired, may comprise electrical heaters or temperature-controlled heat transfer elements located in an area adjacent to the impingement region. Alternatively, the web 60 may be heated through the web support 70. It should be understood, however, that in some embodiments (at least at some steps of the papermaking process), the infrasonic device 22 may not have the means for heating. For example, the infrasonic device 22 may be used at the pre-drying stages of the papermaking process, in which case the infrasonic device 22 is believed to be able to operate effectively at ambient temperature. The infrasonic device 22 can also be used to generate the oscillatory field which is then added to a steady flow impingement gas.

In the instance when the pulse generator 20 comprises the pulse combustor 21, the acoustic frequency of the oscillatory flow-reversing waves depends, at least partially, on the characteristics (such as flammability) of the fuel used in the pulse combustor 21. For both embodiments of the pulse generator 20, the pulse combustor 21 and the infrasonic device 22, several other factors, including design and geometry of the resonance system 30, may also effect the frequency of the acoustic field created by the flow-reversing impingement air or gas. For example, if the resonance system 30 comprises a plurality of resonance tubes 15, as schematically shown in FIGS. 1 and 9, such factors comprise, but are not limited to, a diameter D (FIG. 9) and the length L (FIG. 4) of the tube or tubes 15, number of the tubes 15, and a ratio of a volume of the resonance tube(s) 15 to a volume of the combustion chamber 13 (FIG. 4), or the resonance chamber 23 (FIG. 20).

A Helmholtz-type resonator may be used in the pulse generator 20 of the present invention. As one skilled in the art will recognize, the Helmholtz-type resonator is a vibrating system generally comprising a volume of enclosed air with an open neck or port. The Helmholtz-type resonator functions similarly to a resonance tube having an open and closed ends, described above. Standing acoustic waves having an antinode are produced at the open end of the Helmholtz-type resonator. Correspondingly, a node exists at the closed end of the Helmholtz-type resonator. The Helmholtz-type resonator may not have a constant diameter (and, therefore, volume) along its length. Typically, the Helmholtz-type resonator comprises a large chamber having a chamber volume Wr connected to the resonance tube having a tube volume Wt. The combination of elements having different volumes creates acoustic waves. The preferred Helmholtz-type resonator, and thus Helmholtz-type pulse generator 20, useful in the present invention produces standing waves at the acoustic equivalence of one-quarter (¼) wavelength at a given sound frequency, as has been explained above. The acoustic wave frequency of the Helmholtz-type pulse generator 20 may be described by the following equation: $F=(C/2\pi L)\times(Wt/Wr)^{0.5}$, where: F is the frequency of the oscillatory flow-reversing air or gas, C is the speed of sound, L is the length of the resonance tube, Wt is the volume of the resonance tube, and Wr is the volume of the combustion chamber 13. Thus, the Helmholtz-type pulse generator 20 can be tuned to achieve a given sound frequency by adjusting the chamber volume Wr, the tube volume Wt, and the length L of the tube 15.

Figure 2:
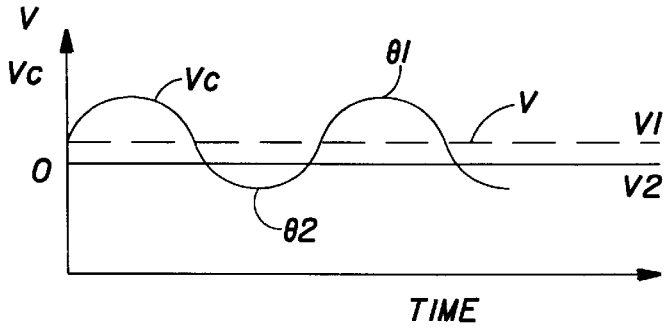
FIG. 2 is a diagram showing a cyclical velocity Vc and a mean velocity V of the oscillatory flow-reversing impingement air or gas, the cyclical velocity Vc comprising a positive-cycle velocity V1 and a negative cycle velocity V2.
Figure 3:
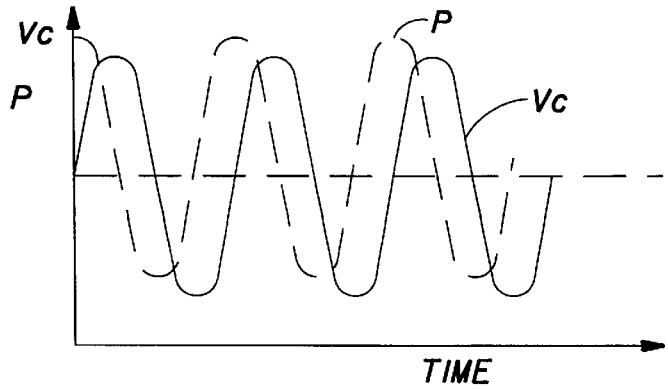
FIG. 3 is a diagram similar to the diagram shown in FIG. 2, and showing off-phase distribution of the cyclical velocity Vc relative to an acoustic pressure P.

The Helmholtz-type pulse generator 20 comprising the pulse combustor 21 is preferred because of its high combustion efficiency and highly-resonant mode of operation. The Helmholtz-type pulse combustor 21 typically yields the highest pressure fluctuations per BTU (i.e., British Thermal Units) per hour of energy release within a given volume Wr of the combustion chamber 13. The resulting high level of flow oscillations provides a desirable level of pressure boost useful in overcoming the pressure drop of a downstream heat-exchange equipment. Pressure fluctuations in the Helmholtz-type pulse combustor 21 used in the present invention generally range from about 1 pound per square inch (psi) during negative peaks Q2 to about 5 psi during positive peaks Q1, as diagramatically shown in FIG. 2. These pressure fluctuations produce sound pressure levels from about 120 decibels (dB) to about 190 dB within the combustion chamber 13. FIG. 3 is a diagram similar to the diagram shown in FIG. 2, and showing off-phase distribution of the cyclical velocity Vc relative to the acoustic pressure P.

The oscillatory flow-reversing impingement gas has two components: a mean component characterized by a mean velocity V and a corresponding mean momentum M; and an oscillatory, or cyclical, component characterized by a cyclical velocity Vc and a corresponding cyclical momentum Mc. Not wishing to be limited by theory, the Applicant believes that the mean and oscillatory components of the flow-reversing impingement gas are principally created in the following manner. The gaseous combustion products exiting the combustion chamber 13 into the gas-distributing resonance system 30 have a significant mean momentum M (proportional to a mean velocity V of the combustion gas and its mass). When the burning of the air-fuel mixture is essentially complete in the combustion chamber 13, an inertia of the combustion gas exiting the combustion chamber 13 at high velocity creates a partial vacuum in the combustion chamber 13, which vacuum causes a portion of exiting combustion gas to return to the combustion chamber 13. The balance of the exhaust gas exit the pulse combustor 20 through the resonance system 30 at the mean velocity V. The partial vacuum created in the combustion chamber 13 opens the inlet valves 11*a* and 12*a* thereby causing the air and fuel to again enter the combustion chamber 13; and the combustion cycle repeats.

As used herein, the oscillatory cycles during which the combustion gas moves "forward" from the combustion chamber 13, and into, through, and from the gas-distributing system 30 are designated as "positive cycles"; and the oscillatory cycles during which a back-flow of the impingement gas occurs are termed herein as "negative cycles." Correspondingly, an average amplitude of the positive cycles is a "positive amplitude"; and an average amplitude of the "negative cycles" is a "negative amplitude." Analogously, during the positive cycles, the impingement gas has a "positive velocity" V1 directed in a "positive direction" D1 towards the web 60 disposed on the web support 70; and during the negative cycles, the impingement gas has a "negative velocity" V2 directed in a "negative direction." The positive direction D1 is opposite to the negative direction D2, and the positive velocity V1 is opposite to the negative velocity V2. The cyclical velocity Vc defines an instantaneous velocity of the oscillatory-flow gas at any given moment during the process, while the mean velocity V characterizes a resulting velocity of the flow-reversing oscillatory field formed by the combustion gas vibrating at the frequency F comprising a sequence of the positive cycles alternating with the negative cycles. One skilled in the art will appreciate that the positive velocity component V1 is greater than the negative velocity component V2, and the mean velocity V has the positive direction D1, hence the resulting oscillatory impingement gas move in the positive direction D1, i.e., exits the pulse combustor 20 into the gas-distributing system 30. It should also be appreciated that since the cyclical velocity Vc constantly changes from the positive velocity V1 to the negative velocity V2 opposite to the positive velocity V1, there must be an instance when the cyclical velocity Vc changes its direction, i.e., the instance when Vc=0 relative to V1 and V2. Consequently, each of the positive velocity V1 and the negative velocity V2 changes its absolute value from zero to maximum to zero, etc. Therefore, it could be said that the positive velocity V1 is an average cyclical velocity Vc during the positive cycles, and the negative velocity V2 is an average cyclical velocity Vc during the negative cycles of the flow-reversing impingement gas.

It is believed that the mean velocity V may be determined by at least two factors. First, the air and the fuel fired in the combustion chamber 13 preferably produces a stoichiometric flow of gas over a desired firing range. If, for example, the combustion intensity needs to be increased, a fuel-feed rate may be increased. As the fuel-feed rate increases, the strength of the pressure pulsation in the combustion chamber 13 increases correspondingly, which, in turn, increases the amount of air aspirated by the air valve 11*a*. Thus, the preferred pulse combustor 21 is capable of automatically maintaining a substantially constant stoichiometry over the desired firing rate. Of course, the combustion stoichiometry may be changed, if desired, by modifying the operational characteristics of the valves 11*a*, 12*a*, geometry of the pulse combustor 21 (including its resonance tailpipe 15), and other parameters. Second, since the combustion gases have a much higher temperature relative to the temperature of the inlet air and fuel, a viscosity of the inlet air and fuel is higher than a viscosity of the combustion gases. The higher viscosity of the inlet air and fuel causes a higher flow resistance through the valves 11*a* and 12*a*, relative to a flow resistance through the resonating system 30.

According to the present invention, the pulse combustor 21 produces an intense acoustic pressure P, in the order of 160–190 dB, inside the combustion chamber 13. The acoustic pressure P reaches its maximum level in the combustion chamber 13. Due to the open end of the resonance tube(s) 15, the acoustic pressure P is reduced at the exit of the resonance tube(s) 15. This drop in the acoustic pressure P results in a progressive increase in cyclical velocity Vc which reaches its maximum at the exit of the resonance tube(s) 15. In the most preferred Helmholtz-type pulse generator 20 the acoustic pressure is minimal at the exit of the resonance tube(s) 15—in order to achieve a maximal cyclical velocity Vc in the exhaust flow of oscillatory impingement gases. The decreasing acoustic pressure P beneficially reduces noise typically associated with sonically enhanced processes of the prior art. For example, in some experiments with the pulse combustor 21, conducted in accordance with the present invention, the acoustic pressure P measured at the distance of from about 1.0 inch to about 2.5 inches from the discharge outlet(s) 39 was approximately from 90 dB to 120 dB. Thus, the preferred process and the apparatus 10 of the present invention operate at a significantly lower noise level relative to the prior art's sonically-enhanced steady impingement processes having the average acoustic pressure of up to 170 dB. (see, for example, U.S. Pat. No. 3,694,926, 2:16–25).

Figure 5:
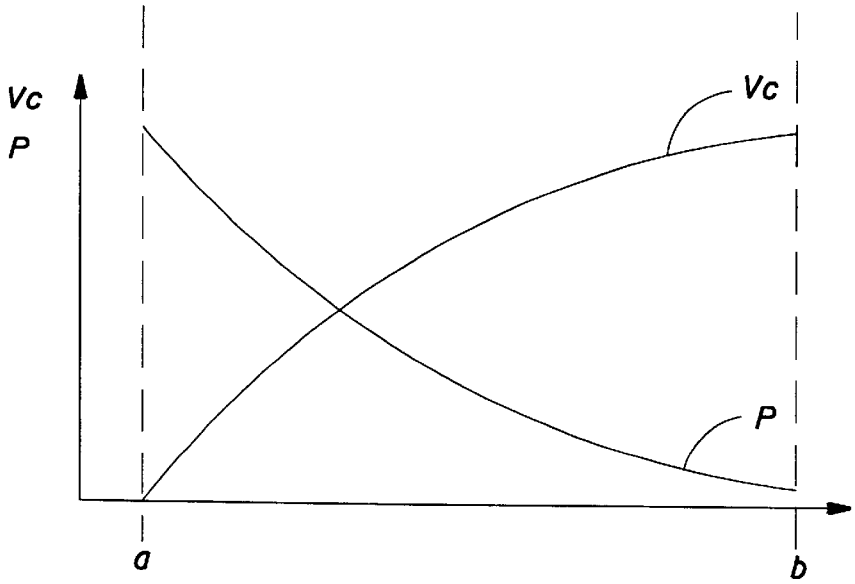
FIG. 5 is a diagram showing interdependency between the acoustic pressure P and the positive velocity Vc within the pulse combustor.

At the exit of the gas-distributing system 30, the cyclical velocity Vc, ranging from about 1,000 feet per minute (ft/min) to about 50,000 ft/min, and preferably from about 2,500 ft/min to about 50,000 ft/min, can be calculated based on the measured acoustic pressure P in the combustion chamber 13. The more preferred cyclical velocity Vc is from about 5,000 ft/min to about 50,000 ft/min. A diagram in FIG. 5 schematically shows interplay between the acoustic pressure P and the cyclical velocity Vc. As has been explained above, according to the preferred process of the present invention, the cyclical velocity Vc increases within the pulse generator 20, reaching its maximum at the exit from the gas-distributing system 30 through the discharge outlet(s) 39, while the acoustic pressure P, produced by the explosion of the fuel-air mixture within the combustion chamber 13, decreases. (In the diagram of FIG. 5, a symbol "a" corresponds to a location inside the combustion chamber 13, where the initial combustion takes place, and a symbol "b" corresponds to the exit from the discharge outlets 39.) According to the present invention, the mean velocity V is from about 1000 ft/min to about 25000 ft/min, and a ratio VcN is from about 1.1 to about 50.0. Preferably, the mean velocity V is from about 2500 ft/min to about 25000 ft/min, and the ratio VcN is from about 1.1 to about 20.0. More preferably, the mean velocity V is from about 5000 ft/min to about 25000 ft/min, and the ratio VcN is from about 1.1 to about 10.0. The cyclical velocity Vc, increases in amplitude from the resonance tube's inlet to the resonance tube's outlet and thus to the discharge outlet 39 of the gas-distributing system 30. This further improves convective heat transfer between the combustion gas and the inner walls of the gas-distributing system 30. According to the present invention, maximum heat transfer is achieved at the exit of the discharge outlets 39 of the gas-distributing system 30.

Pulse combustion is described in several sources, such as, for example, Nomura, et al., Heat and Mass Transfer Characteristics of Pulse-Combustion Drying Process, *Drying*'89, Ed. A. S. Mujumdar and M. Roques, Hemispher/Taylor Francis, N. Y., p.p. 543–549, 1989; V. I. Hanby, Convective Heat Transfer in a Gas-Fired Pulsating Combustor, *Trans. ASME J. of Eng. For Power*, voL 91A, p.p. 48–52, 1969; A. A. Putman, Pulse Combustion, *Progress Energy Combustion Science*, 1986, vol 12, p.p. 4–79, Pergamon Joumal LTD; John M. Corliss, et al., Heat-Transfer Enhancement By Pulse Combustion In Industrial Processes, *Procedures of* 1986 *Symposium on Industrial Combustion Technology, Chicago*, p.p. 39–48, 1986; P. A. Eibeck et al, Pulse Combustion: Impinging Jet Heat Transfer Enhancement, *Combust. Sci. and Tech.*, 1993, Vol. 94, pp. 147–165. These articles are incorporated by reference herein for the purpose of describing pulse combustion and various types of pulse combustors. It should be carefully noted, however, that for the purposes of the present invention, only those pulse combustors are suitable that are capable of creating the impingement gas having oscillating sequence of the positive cycles and the negative cycles, or—as used herein—oscillating flow-reversing impingement gas. The flow-reversing character of the impingement gas provides significant dewatering and energy-saving benefits over the prior art's steady-flow impingement gas, as will be shown further herein below.

The apparatus 10 of the present invention, including the pulse generator 20 and the web support 70, is designed to be capable of discharging the oscillatory flow-reversing impingement air or gas onto the web 60 according to a pre-determined, and preferably controllable, pattern. FIGS. 1, 6, 7, and 8 show several principal arrangements of the pulse generator 20 relative to the web support 70. In FIG. 1, the pulse generator 20 discharges the oscillatory flow-reversing impingement air or gas onto the web 60 supported by the web support 70 and traveling in a machine direction, or MD. As used herein, the "machine direction" is a direction which is parallel to the flow of the web 60 through the equipment. A cross-machine direction, or CD, is a direction which is perpendicular to the machine direction and parallel to the general plane of the web 60. In FIGS. 1 and 9, the resonance gas-distributing system 35 is schematically shown as comprising several cross-machine-directional rows of resonance tubes, or slots, 15, each having at least one discharge outlet 39. However, it should be understood that the number of the tubes 15 or outlets 39, as well as a pattern of their distribution relative to the surface of the web 60, may be influenced by various factors, including, but not limited to, parameters of the overall dewatering process, characteristics (such as temperature) of the impingement air or gas, type of the web 60, an impingement distance Z (FIGS. 1 and 7A) formed between the discharge outlets 39 and the web support 70, residence time, the desired fiber-consistency of the web 60 after the dewatering process of the present invention is completed, and others. The outlets 39 need not have a round shape of an exemplary embodiment shown in FIG. 9. The outlets 39 may have any suitable shape, including but not limited to a generally rectangular shape shown in FIG. 4B.

As used herein, the term "impingement distance," designated as "Z." means a clearance formed between the discharge outlets 39 of the gas-distributing system 30 and the web-contacting surface of the web support 70. In the preferred embodiment of the apparatus 10 of the present invention, a means for controlling the impingement distance Z may be provided. Such means may comprise conventional manual mechanisms, as well as automated devices, for causing the outlets 39 of the gas-distributing system 30 and the web support 70 to move relative to each other, i.e., toward and away from each other, thereby adjusting the impingement distance Z. Prophetically, the impingement distance Z may be automatically adjustable in response to a signal from a control device 90, as schematically shown in FIG. 1. The control device measures at least one of the parameters of the dewatering process or one of the parameters of the web 60. For example, the control device may comprise a moisture-measuring device which is designed to measure the moisture content of the web 60 before and/or after the web 60 is subjected to water removal, or during the process of water removal (FIG. 1). When the moisture content of the web 60 is higher or lower then a certain pre-set level, the moisture-measuring device sends an error signal to adjust the impingement distance Z accordingly. Alternatively or additionally, the control device 90 may comprise a temperature sensor designed to measure the temperature of the web 60 while the web 60 is subjected to the flow-reversing impingement according to the present invention. One skilled in the art will appreciate that ordinarily, paper tolerates temperatures not greater than 300° F.–400° F. Therefore, control of the web's temperature may be important, especially in the process of the present invention, in which the flow-reversing impingement gas may have the temperature up to 2500° F. when exiting the discharge outlets 39 of the gas-distributing system 30. Prophetically, therefore, the impingement distance Z can be automatically adjustable in response to a signal from the control device 90, which is designed to measure the temperature of the web 60. When the temperature of the web 60 is higher than a certain pre-selected threshold, the control device 90 sends an error signal to accordingly adjust (presumably, increase) the impingement distance Z, thereby creating conditions for decreasing the temperature of the web 60. These and other parameters of the dewatering process, alone or in combination, may be used as input characteristics for adjusting the impingement distance Z.

Figure 4A:
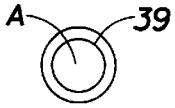
FIG. 4A is a partial view taken along line 4A—4A of FIG. 4, and showing a round discharge outlet of the pulse combustor, the discharge outlet having a diameter D and an open area A.

In the preferred embodiment, the impingement distance Z may vary from about 0.25 inches to about 6.0 inches. The impingement distance Z defines an impingement region, i.e., the region between the discharge outlet(s) 39 and the web support 70, which region is penetrated by the oscillatory flow-reversing gas produced by the pulse generator 20. In the preferred embodiment of the apparatus 10 and the process of the present invention, a ratio of the impingement distance Z to an equivalent diameter D of the discharge outlet 39, i.e., the ratio Z/D, is from about 1.0 to about 10.0. The "equivalent diameter D" is used herein to define the open area A of the outlet 39 having a non-circular shape, in relation to the equal open area of the outlet 39 having a circular geometrical shape. An area of any geometrical shape can be described according to the formula: $S=\frac{1}{4}\pi D^2$, where S is the area of any geometrical shape, $\pi=3.14159$, and D is the equivalent diameter. For example, the open area of the outlet 39 having a rectangular shape can be expressed as a circle of an equivalent area "s" having a diameter "d." Then, the diameter d can be calculated from the formula: $s=\frac{1}{4}\pi d^2$, where s is the known area of the rectangle. In the foregoing example, the diameter d is the equivalent diameter D of this rectangular. Of course, the equivalent diameter of a circle is the circle's real diameter (FIGS. 4 and 4A).

Various designs of the gas-distributing system 30 suitable for delivering the oscillatory field of flow-reversing gas onto the web 60 include those comprising a single straight tube, or slot, 15 (FIG. 4), or a plurality of tubes 15 (FIG. 1). The geometrical shape, relative size, and the number of the tubes 15 depend upon the required heat transfer profile, the relative size of an area of the drying surface, and other parameters of the process. Regardless of its specific design, the gas-distributing system 30 must possess certain characteristics. First, if the gas-distributing system 30 comprises resonance tubes 15 thereby forming the resonance gas-distributing system 35, as was explained above, the resonance gas-distributing system 35 must transform, or convert, the combustion gas produced inside the combustion chamber 13 into the oscillatory flow-reversing impingement gas, as described above. Second, the gas-distributing system 30 must deliver the oscillatory flow-reversing impingement gas onto the web 60. By the requirement that the gas-distributing system 30 must deliver the impingement gas onto the web 60, it is meant that the impingement gas must actively engage the moisture contained in the web 60 such as to at least partially remove this moisture from the web 60 and from a boundary layer adjacent to the web 60. It should be understood that the requirement that the impingement gases be delivered onto the web 60 does not exclude that the impingement gases may penetrate, at least partially, the web 60. Of course, in some embodiments of the present invention, the impingement gases can penetrate the web 60 throughout the web's entire caliper, or thickness, thereby displacing, heating, evaporating and removing water from the web 60.

Figure 11:
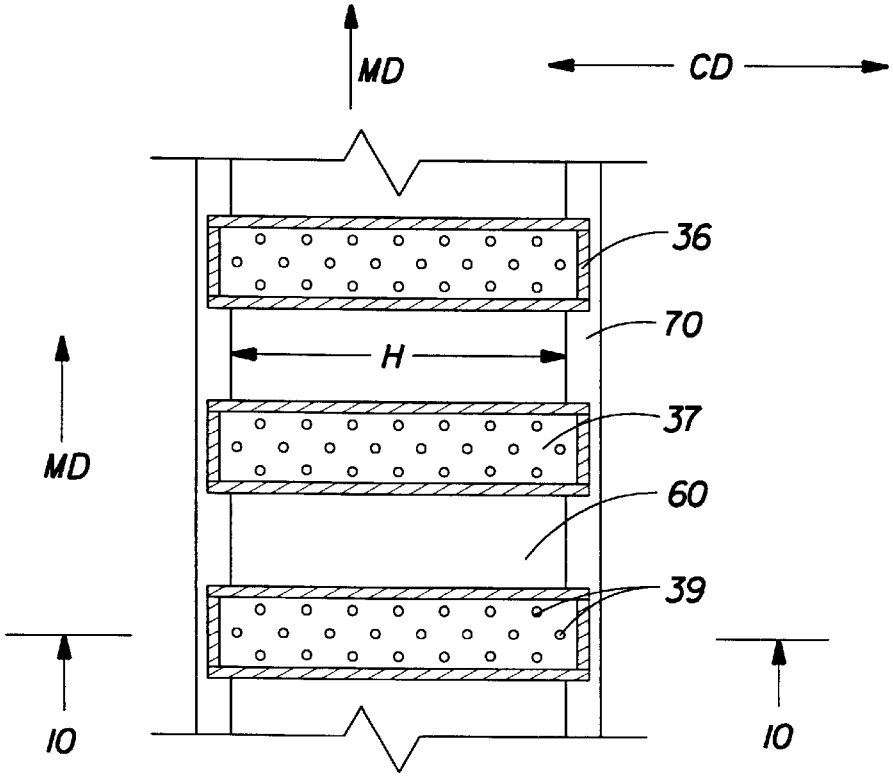
FIG. 11 is a schematic plan view, taken along line 11—11 of FIG. 10, and showing multiple blow boxes successively spaced in the machine direction.

The design of the gas-distributing system 30 can be critical for obtaining desirable high water-removal (i.e., web-dewatering and/or drying) rates—up to 150 pounds per square foot per hour ($lb/ft^2 \cdot hr$) and higher, in accordance with the present invention. Not only a resulting open area of the discharge outlets 39, in relation to an impingement area of the web 60, is important, but also a pattern of distribution of the discharge outlets 39 throughout the web's impingement area. As used herein, the term "resulting open area," designated as "ΣA," refers to a combined open area formed by all individual open areas A of the outlets 39 together. An area of a portion of the web 60 impinged upon by the oscillatory flow-reversing impingement field at any moment of the continuous process is designated herein as an "impingement area E." The impingement area E can be calculated as E=RH, where R is a length of the impingement area E (FIG. 1), and H is a width of the web 60 (FIGS. 9 and 11). The distance R is defined by the geometry of the gas-distributing system 30, specifically by a machine-directional dimension of the pattern of the plurality of the discharge outlets 39, as best shown in FIG. 1. The impingement area E is, in other words, an area corresponding to a region outlined by the pattern of the plurality of the discharge outlets 39. A relationship between the resulting open area ΣA and the web's impingement area E can be defined by a ratio ΣA/E, which may be from 0.002 to 1.000. According to a preferred embodiment of the present invention, the ratio ΣA/E is from 0.005 to 0.200 (i.e., ΣA comprises from 0.5% to 10% relative to E). The more preferred ratio ΣA/E is from 0.010 to 0.100.

According to the present invention, for the web 60 having moisture content from about 10% to about 60%, the water-removal rates are higher than 25–30 $lb/ft^2 \cdot hr$. The preferred water-removal rates are higher than 50–60 $lb/ft^2 \cdot hr$. The more preferred water-removal rates are from 75 $lb/ft^2 \cdot hr$ to 150 $lb/ft^2 \cdot hr$ and even higher. In order to achieve the desired water-removal rates for the web 60, the oscillatory flow-reversing impingement gas should preferably form an oscillatory "flow field" substantially uniformly contacting the web 60 throughout the surface of the web 60, at the impingement area E. The oscillatory field can be created when the flow of the oscillatory gas from the gas-distributing system 30 is substantially equally split and impinged onto the drying surface of the web 60 through a network of the discharge outlets 39. Also, temperature control of the oscillatory impingement gas within the gas-distributing system 30 may be necessary due to possible density effects within the pulse combustor 21 and the gas-distributing system 30. Control of the gas temperature at the exit from the gas-distributing system 30 through the discharge outlet(s) 39 is desirable because it helps one to control the water-removal rates in the process. One skilled in the art will readily appreciate that control of the gas temperature can be accomplished by the use of water-cooled jackets or air/gas-cooling of the outside surfaces of the pulse combustor 21 and the gas-distributing system 30. Pressurized cooling air and heat-transfer fins may also be used to control the gas temperature at the discharge outlets 39 and to recover heat in the pulse combustor 21, as well as to control the location of the combustion flame front in the resonance tube(s) 15.

It has been found that the oscillatory field can be distributed using the outlets 39 having a variety of geometrical shapes, provided several guidelines are preferably followed. First, the resonance gas-distributing system 35 should preferably have equal volumes and lengths in each tube 15, in order to maintain such acoustic-field properties as to ensure that the acoustic pressure generated in the combustion chamber 13 is maximally and uniformly converted into the oscillatory field at the exit from the discharge outlets 39. Second, the design of the resonance gas-distributing system 35 (or of the gas-distributing system 30) should preferably minimize "back" pressure in the combustion chamber 13. Back pressure may adversely effect the operation of the air valve 11*a* (especially, when it is of aerodynamic nature), and consequently reduce the dynamic pressure generated by the pulse combustor, and the oscillatory velocity Vc of the impingement gases. Third, the resulting open area ΣA of the plurality of the discharge outlets 39 should correlate with a resulting open (cross-sectional) area of the tube or tubes 15. It means that in some embodiments the resulting open area ΣA of the plurality of the discharge outlets 39 should preferably be equal to a resulting open (cross-sectional) area of the tube or tubes 15. In other embodiments, however, it may be desirable to have unequal open areas to provide control of the (presumably uniform) temperature profile of the oscillatory field of the flow-reversing gas. By analogy with the resulting open area ΣA of the discharge outlets 39, one skilled in the art would understand that the "resulting open area of the tube or tubes 15" refers to a combined open area formed by the individual tube or tubes 15, as viewed in an imaginary cross-section perpendicular to a stream of oscillatory gas.

Figure 4B:
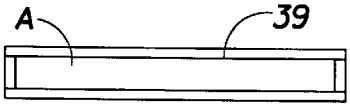
FIG. 4B is another embodiment of the discharge outlet of the pulse combustor, having a rectangular shape.

A pattern of distribution of the discharge outlets 39 in plan view, relative to the web 60, may vary. FIG. 9, for example, shows a non-random staggered array of distribution. Patterns of distribution comprising non-random staggered arrays facilitate more even application of the impingement gas, and therefore more uniform distribution of the gas temperature and velocity, relative to the impingement area of the web 60. The discharge outlets 39 may have a substantially rectangular shape, as shown in FIG. 4B. Such rectangular discharge outlets 39 can be designed to cover the entire width of the web 60, or—alternatively—any portion of the width of the web 60.

Figure 10:
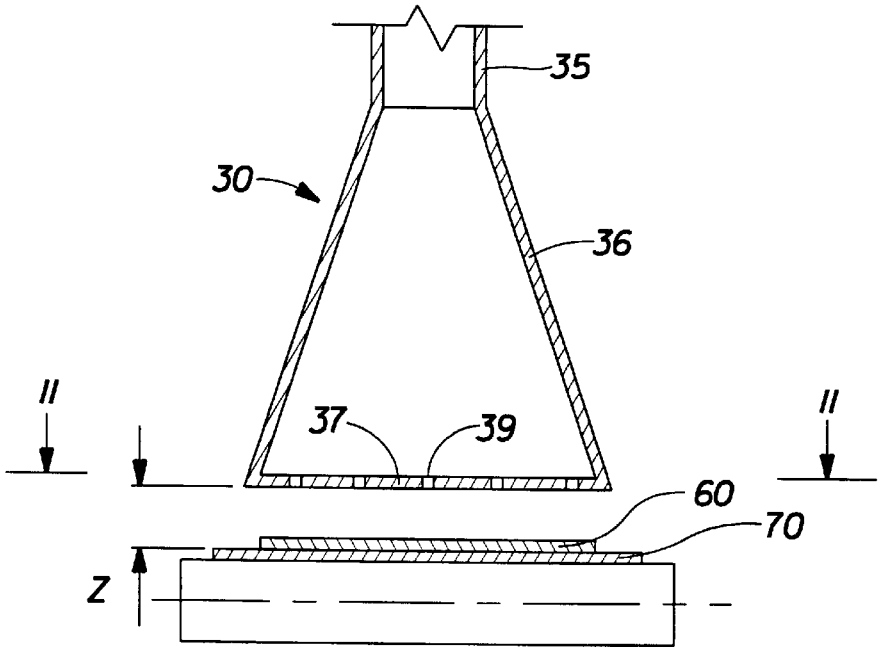
FIG. 10 is a schematic cross-sectional view of one preferred embodiment of the pulse generator's gas-distribution system terminating with a blow box having a plurality of discharge orifices extending through the blow box's bottom.
Figure 12:
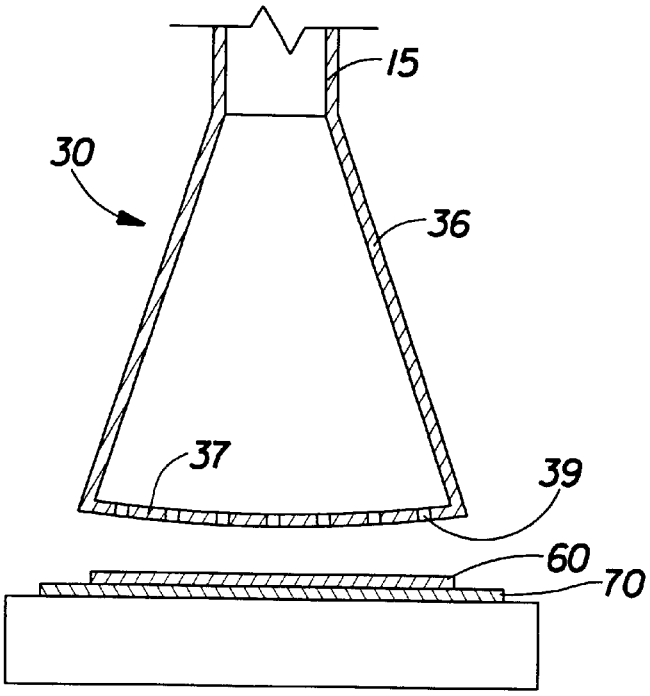
FIG. 12 is a schematic cross-sectional view of an embodiment of the blow box having a curved convex bottom.
Figure 13A:
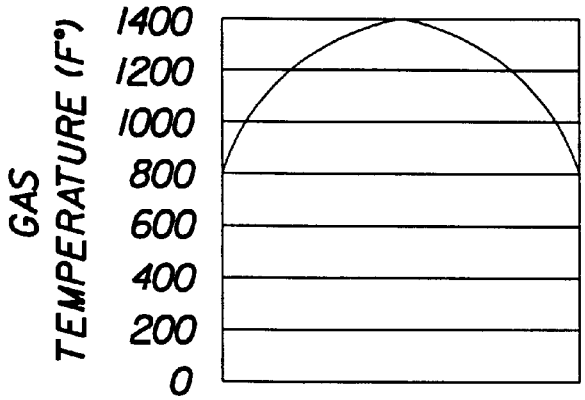
FIG. 13A is a schematic diagram showing distribution of the temperature of the oscillatory flow-reversing gas or air at the exit from the blow-box having the curved bottom schematically shown in FIG. 12, or sectional bottom schematically shown in FIG. 13.
Figure 14:
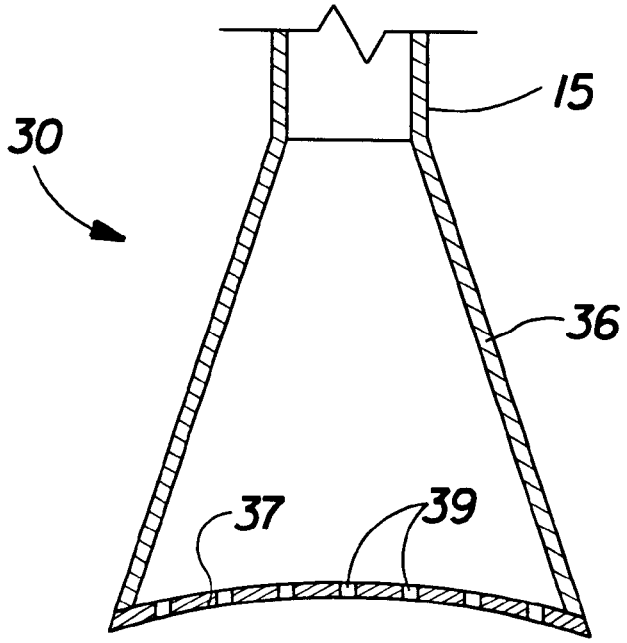
FIG. 14 is a schematic cross-sectional view of an embodiment of the blow box having a curved concave bottom.
Figure 14A:
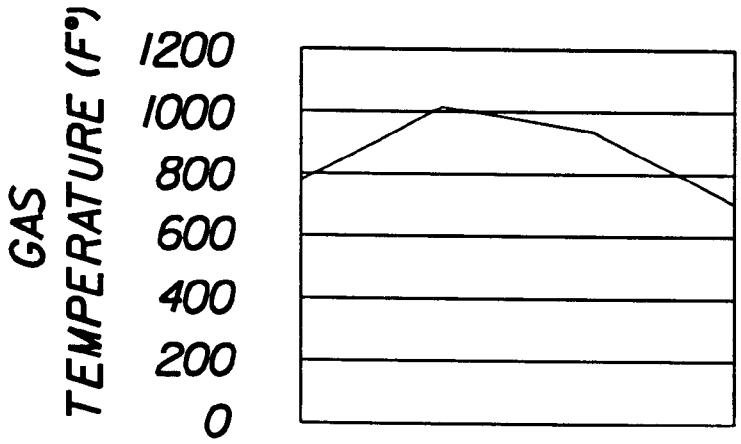
FIG. 14A is a schematic diagram showing distribution of the temperature of the flow-reversing impingement gasses at the exit from the blow-box having the curved concave bottom schematically shown in FIG. 14.

FIGS. 10 and 11 show the gas-distributing system 30 comprising a plurality of blow boxes 36, each terminating with a bottom plate 37 comprising the plurality of the discharge outlets 39. The discharge outlets 39 can be formed as perforations through the bottom plate 37, by any other method known in the art. In FIG. 10, the blow box 36 has a generally trapezoidal shape, but it should be understood that other shapes of the blow box 36 are possible. Likewise, while the blow box shown in FIG. 10 has a substantially planar bottom plate 37, it has been discovered that a non-planar or curved shape of the bottom plate 37 may be possible, and even preferable. For example, FIG. 12 shows the blow box 36 having a convex bottom plate 37; and FIG. 14 shows the blow box 36 having a concave bottom plate 37. It has been found that the convex shape of the bottom plate 37 provides higher temperatures of the oscillatory gas in the impingement region, relative to the planar shape of the bottom plate 37, FIG. 13A. At the same time, the concave shape of the bottom plate 37 provides a more uniform distribution of the gas temperature across the impingement area of the web 60, relative to the temperature distribution provided by the planar bottom plate, all other characteristics of the process and the apparatus being equal, FIG. 14A.

Figure 13:
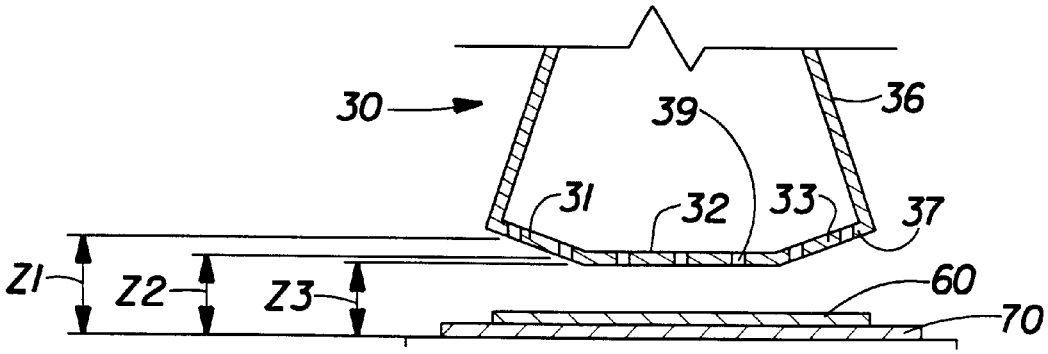
FIG. 13 is a schematic cross-sectional view of an embodiment of the blow box having a bottom comprising a plurality of interconnected sections forming a generally convex shape of the blow box's bottom.

While FIG. 12 shows the bottom plate 37 which is convex and is curved in cross-section, FIG. 13 shows another embodiment of a generally convex bottom plate 37, formed by a plurality of sections. FIG. 13 schematically shows the bottom plate 37 comprising three sections: a first section 31, a second section 32, and a third section 33. In the shown cross-section, the sections 31, 32, and 33 form angles therebetween, thereby forming a "broken line" in the cross-section shown. Of course, a number of the sections, as well as their shape may differ from those shown in FIG. 13. For example, each of the sections 31, 32, and 33, shown in FIG. 13 has a substantially planar cross-sectional configuration. However, each of the sections 31, 32, and 33 may be individually curved (not shown), analogously to the bottom plate 37 shown in FIG. 12.

One skilled in the art should appreciate that in the context of the bottom plate 37 having a convex shape (whether or not curved), the impingement distance Z, defined herein above, may differentiate among the discharge outlets 39. Therefore, as used herein, the impingement distance Z in the context of the convex bottom plate 37 is an average arithmetic of all individual impingement distances Z1, Z2, Z3, etc. (FIGS. 12 and 13) between the web-contacting surface of the web support 70 and respective individual discharge outlet 39, taking into account relative open areas A and relative numbers of the discharge outlets 39 per unit of the impingement area of the web 60. For example, FIG. 13 shows that the bottom plate 37 has, in the cross-section, three discharge outlets 39 (in the section 32) having the impingement distance Z3, two discharge outlets 39 (one in each of the sections 31 and 33) having the impingement distance Z2, and two discharge outlets 39 (one in each of the sections 31 and 33) having the impingement distance Z2. Then, assuming that all discharge outlets 39 have mutually equal open areas A, the impingement distance for the entire bottom plate is computed as $(Z3\times3+Z1\times2+Z2\times2)/7$. If the discharge outlets 39 have unequal open areas A, the differential areas A should be included into the equation, to account for differential contribution of the individual discharge outlets 39. The individual impingement distance Z1, Z2, Z3, etc. is measured from the point in which a geometrical axis of the discharge outlet 39 crosses an imaginary line formed by a web-facing surface of the bottom plate 37. The same method of computing the impingement distance Z may be applied, if appropriate, in the context of the web support 70 comprising a drying cylinder 80, FIGS. 7, 7A and 8(IV), as one skilled in the art will appreciate.

Figure 9A:
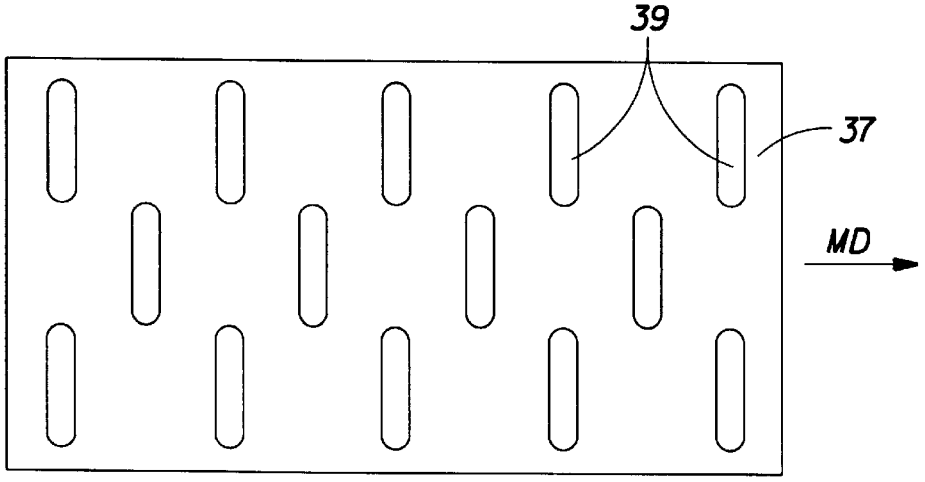
FIG. 9A is a schematic plan view of the discharge outlets, comprising a substantially rectangular orifices distributed in a non-random pattern.

Other designs and permutations of the gas-distributing system 30, including the discharge outlets 39, are contemplated in the present invention. For example, the plurality of orifices in the plates 37 may comprise oblong slit-like holes distributed in a pre-determined pattern, as schematically shown in FIG. 9A. Likewise, a combination (not shown) of the round discharge outlets 39 and the slit-like discharge outlets 39 may be used, if desired, in the apparatus 10 of the present invention.

It is also believed that an angled application of the oscillating flow-reversing air or gas may be beneficially used in the present invention. By "angled" application it is meant that the positive direction of the stream of the oscillating air or gas and a web-contacting surface of the web support 70 form an acute angle therebetween. FIGS. 12 and 13 illustrate such an angled application of the oscillating impingement air or gas. It should be carefully noted, however, that the angled application of the oscillating air or gas is not necessarily consequential of the convex, concave, or otherwise curved (or "broken") shape of the bottom plate 37. In other words, the curved or broken bottom plate 37 can be easily designed to provide a non-angled (i.e., perpendicular to the web support 70) application of the oscillating air or gas, as best shown in FIG. 13. Similarly, the planar bottom plate 37 can comprise the discharge outlets 39 designed to provide the angled application of the oscillatory flow-reversing air or gas (not shown). Of course, the angled application of the oscillatory air or gas may be provided by a means other than the blow box 36, for example, by a plurality of individual tubes, each terminating with the discharge outlet 39, and without the use of the blow box 36. While denying to be limited by theory, Applicant believes that the web-dewatering benefits provided by the angled application of the oscillating air or gas may be attributed to the fact that a "wiping" effect of the angled streams of oscillating air or gas is facilitated by the existence of the acute angle(s) between the gas stream(s) and the surface of the web 60.

Figure 12A:
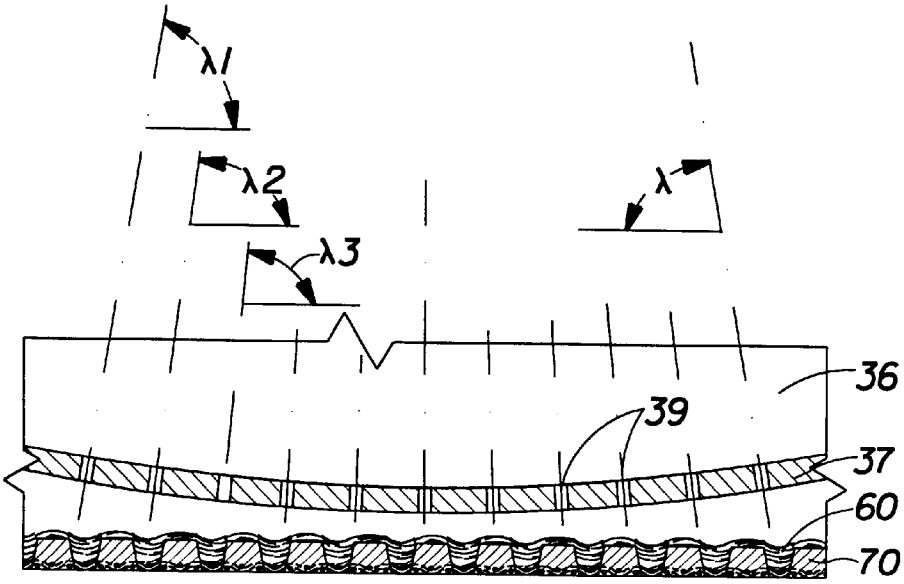
FIG. 12A is a schematic and more detailed cross-sectional view of the blow box shown in FIG. 12, providing an angled application of the oscillatory air or gas, relative to a fluid-permeable web support.

In FIG. 12A, a symbol "$\lambda$" designates a generic angle formed between the general, or macroscopically monoplanar, surface of the web support 70 and the positive direction of the oscillating stream of air or gas through the discharge outlet 39. As used herein, the terms "general" surface (or plan) and "macroscopically monoplanar" surface both indicate the plan of the web support 70 when the web support 70 is viewed as a whole, without regard to structural details. Of course, minor deviation from the absolute planarity may be tolerable, while not preferred. It should also be recognized that the angled application of the oscillating flow-reversing air or gas may be possible relative to the cross-machine direction (FIG. 12), the machine direction (not shown), and both the machine direction and the cross-machine direction (not shown). According to the present invention, the angle $\lambda$ is from almost 0° to 90°. Also, the individual angles $\lambda$ ($\lambda1$, $\lambda2$, $\lambda3$) can (and in some embodiments preferably do) differentiate therebetween, as best shown in FIG. 12A: $\lambda1>\lambda2>\lambda3$. One skilled in the art will appreciate that the teachings provided herein above with regard to the angle $\lambda$ may also be applicable, by analogy, to the concave bottom plate 37, shown in FIG. 14.

Figure 15:
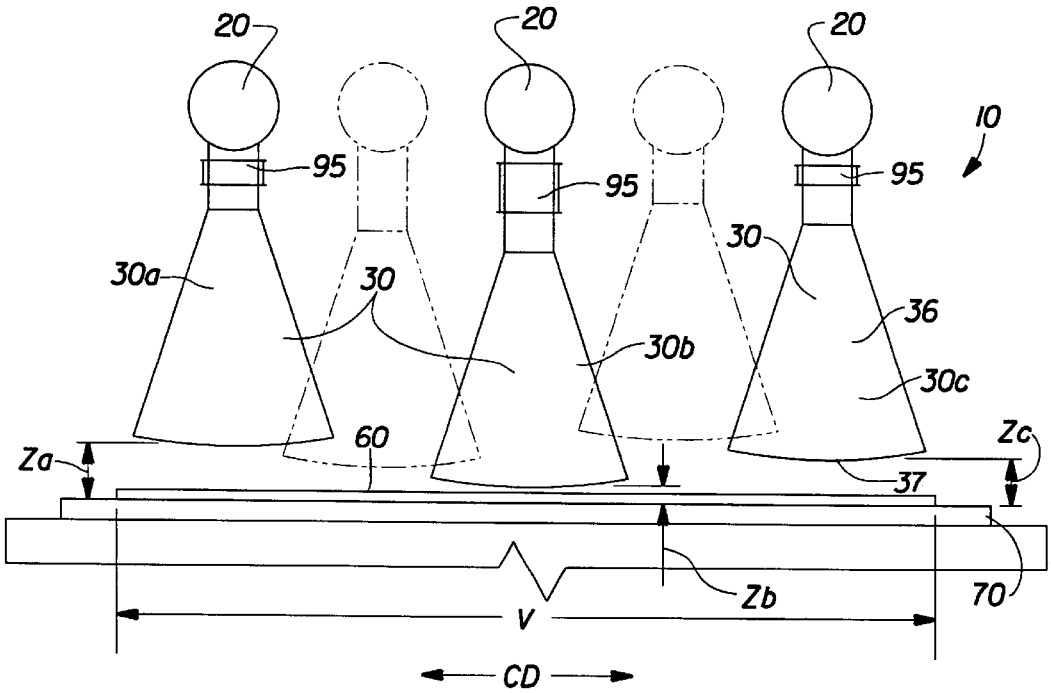
FIG. 15 is a schematic side elevational view of an embodiment of the process, showing a plurality of pulse generators spaced apart from one another in the cross-machine direction.

FIG. 15 schematically shows an embodiment of the process of the present invention, in which a plurality of the gas distributing systems 30 (30*a*, 30*b*, and 30*c*) is used across the width of the web 60. This arrangement allows a greater flexibility in controlling the conditions of the web-dewatering process across the width of the web 60, and thus in controlling relative humidity and/or dewatering rates of the differential (presumably, in the cross-machine direction) portions of the web 60. For example, such arrangement allows one to control the impingement distance Z individually for differential portions of the web 60. In FIG. 15, the gas-distributing system 30*a* has an impingement distance Za, the gas-distributing system 30*b* has an impingement distance Zb, and the gas-distributing system 30*c* has an impingement distance Zc. Each of the impingement distances Za, Zb, and Zc may be individually adjustable, independently from one another. A means 95 for controlling the impingement distance Z can be provided. While FIG. 15 shows three pulse generators 20, each having its own gas-distributing system 30, it should be understood that in other embodiments, a single pulse generator 20 can have a plurality of gas-distributing systems 30, each having means for the individually-adjustable impingement distance Z.

In the embodiments of the process of the present invention, comprising two or more pulse combustors 21, a pair of pulse combustors 21 may advantageously operate in a tandem configuration, in close proximity to each other. This arrangement (not illustrated) may result in a 180°-phase lag between the firing of the tandem pulse combustors 21, which could produce an additional benefit by reducing noise emissions. This arrangement can also produce higher dynamic pressure levels within the pulse combustors, which, in turn, cause a greater cyclical velocity Vc of the oscillatory flow-reversing impingement gases exiting the discharge outlets 39 of the resonance system 30. The greater cyclical velocity Vc enhances dewatering efficiency of the process.

Figure 6:
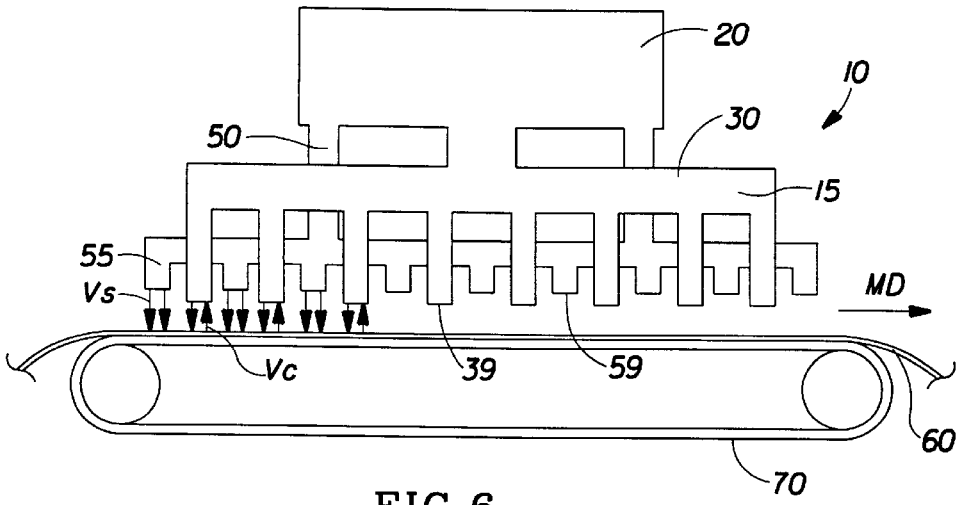
FIG. 6 is a schematic and simplified side elevational view of an embodiment of the apparatus and the process of the present invention, showing a pulse generator sequentially impinging oscillatory flow-reversing impingement air or gas alternating with steady-flow impingement air or gas onto the web supported by an endless belt or band traveling in a machine direction.

According to the present invention, the oscillatory field of the flow-reversing impingement gas may beneficially be used in combination with a steady-flow impingement gas. A particularly preferred mode of operation comprises sequentially-alternating application of the oscillatory flow-reversing gas and the steady-flow gas. FIG. 6 schematically shows a principal arrangement of such an embodiment of the process. In FIG. 6, the gas-distributing system 30 delivers the oscillatory flow-reversing impingement gas through the tubes 15 having the discharge outlets 39; and a steady-flow gas-distributing system 55 delivers steady-flow impingement gas through the tubes 55 having discharge outlets 59. In FIG. 6, directional arrows "Vs" schematically indicate the velocity (or movement) of the steady-flow gases, and directional arrows "Vc" schematically indicate the cyclical velocity (or oscillatory movement) of the oscillatory flow-reversing gases. As the web 60 travels in the machine direction MD, the oscillatory flow-reversing gas and the steady-flow (non-oscillatory) gas sequentially impinge upon the web 60. This order of treatment can be repeated many times along the machine direction, as the web 60 travels in the machine direction. It is believed that the oscillatory flow field "scrubs" the residual water vapor, comprising a boundary layer, above the drying surface of the web 60, thereby facilitating removal of the water therefrom by the steady-flow impingement gas. This combination increases the drying performance of the steady-flow impingement drying system. It should be appreciated that in the process comprising application of the combination of the steady-flow gas and the oscillatory flow-reversing gas, the angled application of the impingement gas is contemplated in the present invention. In this instance, one of or both the oscillatory gas and the steady-flow gas can comprise jet streams having the "angled" position relative to the web support 70, as has been explained in greater detail above.

In FIG. 6, a means for generating oscillatory and steady-flow impingement gases are schematically shown as comprising the same pulse generator 20. In this instance, control of the temperature of the steady-flow gas may be necessary to prevent thermal damage to the web 60 or to control the water-removal rates. It is to be understood, however, that a separate steady-flow generator (or generators) may be provided, which is (are) independent of the pulse generator 20. The latter arrangement is within the scope of knowledge of one skilled in the art, and therefore is not illustrated herein.

Injection of diluents during the combustion cycle of the pulse combustor, either continuously, or periodically to match the operating frequency of the combustor, is contemplated in the present invention. As used herein, the "diluents" comprise liquid or gaseous substances that may be added into the combustion chamber 13 of the pulse combustor 21 to produce an additional gaseous mass thereby increasing the mean velocity V of the combustion gases. The addition of purge gas can also be used to increase the mean velocity V of the oscillatory flow field produced by the pulse combustor 21. The higher mean velocity V will, in turn, alter the flow-reversal characteristics of the oscillatory flow field over a wide range. This is advantageous in providing additional control over the oscillatory-flow field's characteristics, separately from controlling the same by the geometry of the gas-distributing system 30, characteristics of the aerodynamic air valve 11*a*, and thermal firing rate of the pulse combustor 21. Further, if a diluant gas, such as carbon dioxide ($CO_2$), is used, the higher enthalpy value (i.e., heat content) may be beneficial to increase the overall heat flux of the oscillatory flow-field impinged upon the web 60. An increase of the mean velocity V also facilitates convective mass transfer which in turn enhances water-removal efficiency of the process.

Combustion by-products produced in a Helmholtz-type pulse combustor operating on natural gases typically contains about 10–15% water vapor. The water exists as superheated steam vapor due to the high operational temperature of the pulse combustor and the resultant combustion gas. The injection of additional water or steam into the pulse combustor 21 is contemplated in the process and the apparatus 10 of the present invention. This injection may produce additional superheated steam, in situ, without the need for ancillary steam-generating equipment. The addition of superheated steam to the oscillatory flow-reversing field of impingement gas may be effective in increasing the resulting heat flux delivered unto the paper web 60.

The pulse combustor 21 of the present invention may also include means for forcing air into the combustion chamber 13, to increase an intensity of the combustion. In this instance, first, a higher flow resistance increases the dynamic pressure amplitude in the Helmholtz resonator. Second, the use of the pressurized air tends to supercharge the combustor 21 to higher firing rates than those obtainable at atmospheric aspirating conditions. The use of an air plenum, thrust augmenter, or supercharger are contemplated in the present invention.

FIG. 8 schematically shows several principal locations (I, II, III, IV, and V) of the impingement regions in the overall papermaking process. It should be understood that the locations shown are not intended to be exclusive, but intended to simply illustrate some of the possible arrangements of the drying apparatus 10 in conjunction with a particular stage of the overall papermaking process. It should also be understood that while FIG. 8 schematically shows a through-air drying process, the apparatus 10 of the present invention is equally applicable to other papermaking processes, such as, for example, conventional processes (not shown). As one skilled in the art will recognize, the several papermaking stages shown in FIG. 8 include: forming (location I), wet transfer (location II), pre-drying (location II), drying cylinder (such as Yankee) drying (location IV), and post-drying (location V). As has been pointed out above, the characteristics of the process of the present invention, including the physical characteristics of the impingement gases, are determined by many factors, including the moisture content of the web 60 at a particular stage of the papermaking process.

Figure 7:
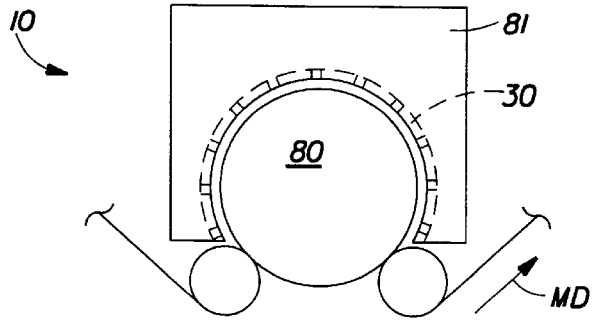
FIG. 7 is a schematic partial view of the apparatus of the present invention, comprising a dryer hood of a drying cylinder, the web being supported by the dryer cylinder.
Figure 7A:
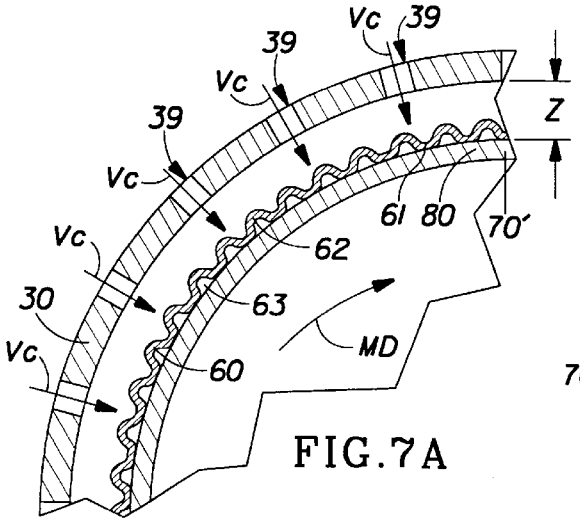
FIG. 7A is a partial schematic cross-sectional view of the apparatus of the present invention, including web support comprising a drying cylinder carrying a web thereon and a pulse generator's gas-distributing system comprising a plurality of the discharge outlets.

One preferred location of the impingement region is an area formed between a drying cylinder 80 and a drying hood 81 juxtaposed with the drying cylinder 80, as shown in FIGS. 7, 7A and 8 (location IV). The oscillatory flow-reversing field of the impingement gas improves both the convective heat transfer and the convective mass transfer of the gas used in the drying hood 81. This can result in increased water removal rates, compared to conventional steady-flow impingement hoods, and allow higher paper machine velocities. As shown in FIG. 8 (location IV), the impingement hood may be located on the "wet" end of the cylinder dryer. The drying residence time can be controlled by the combination of hood wrap around the drying cylinder and machine speed. The process is particularly useful in the elimination of moisture gradients present in the differential-density structured paper webs made by the present assignee, as will be explained in greater detail herein below.

Figure 16:
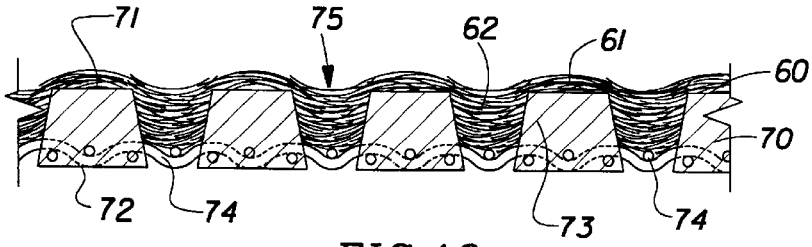
FIG. 16 is a partial and schematic side elevational view of an embodiment of a fluid-permeable web support comprising a substantially continuous framework joined to a reinforcing structure, the web support having a fibrous web thereon.
Figure 17:
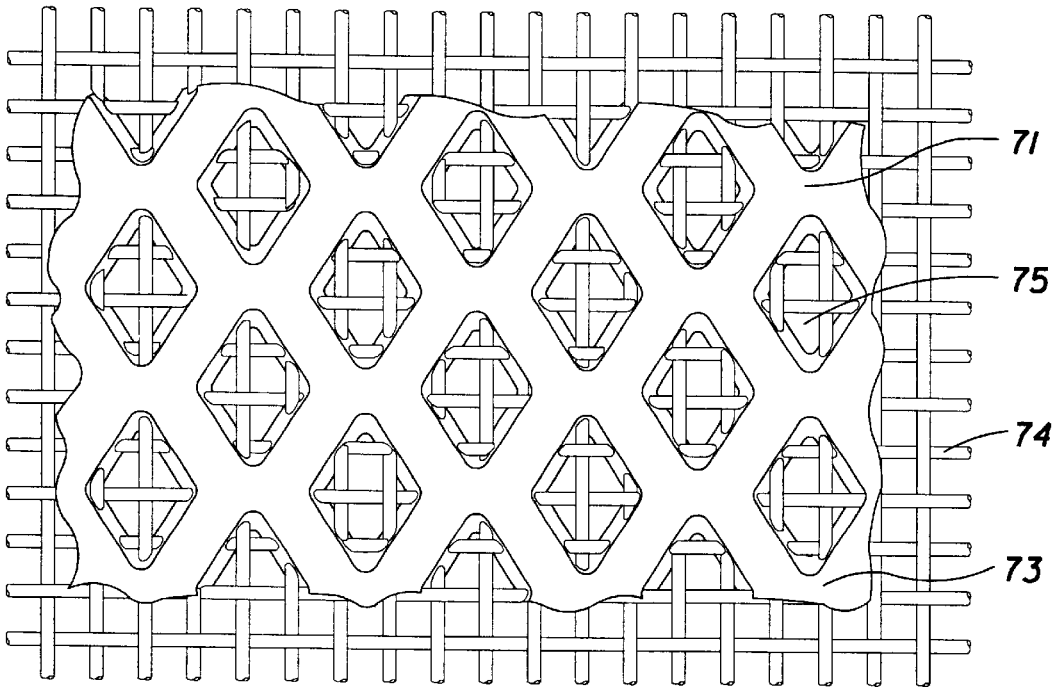
FIG. 17 is a partial schematic plan view of the web support shown in FIG. 16 (the fibrous web is not shown for clarity).
Figure 18:
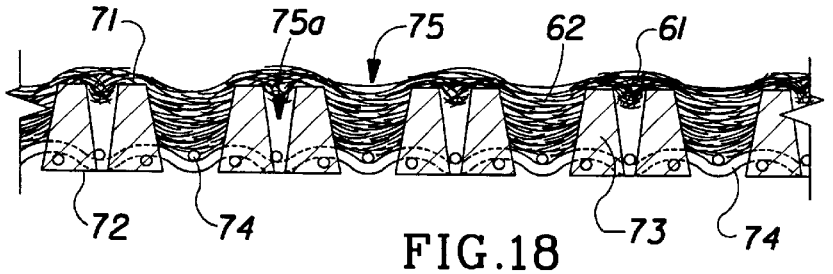
FIG. 18 is a partial schematic side elevational view of an embodiment of the fluid-permeable web support comprising a plurality of discrete protuberances joined to a reinforcing structure, the web support having a fibrous web thereon.
Figure 19:
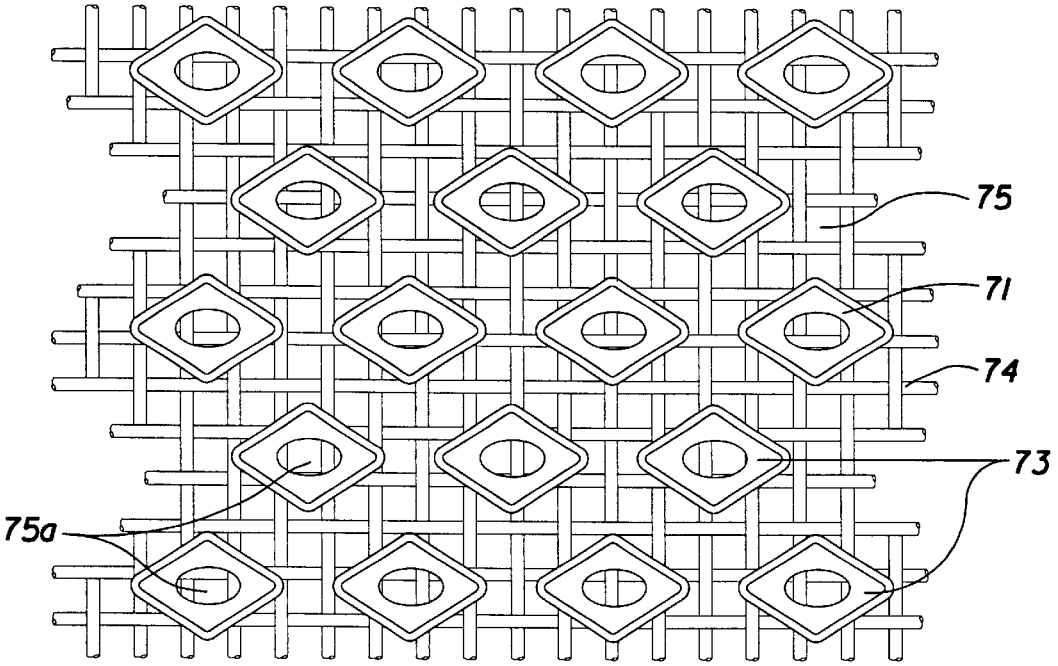
FIG. 19 is a partial schematic plan view of the web support shown in FIG. 18 (the fibrous web is not shown for clarity).

Typically, through-air-drying processes of the prior art use fluid-permeable web supports 70, comprising endless papermaking belts in full-scale industrial applications. FIGS. 16–19 schematically show two exemplary embodiments of the fluid-permeable web support comprising an endless papermaking belt used by the present assignee in through-air-drying processes. The web-support 70 shown in FIGS. 16–19 has a web-contacting surface 71 and a backside surface 72 opposite to the web-contacting surface 71. The web support 70 further comprises a framework 73 joined to a reinforcing structure 74, and a plurality of fluid-permeable deflection conduits 75 extending between the web-contacting surface 71 and the backside surface 72. The framework 73 may comprise a substantially continuous structure, as best shown in FIG. 17. In this instance, the web-contacting surface 71 comprises a substantially continuous network. Alternatively, or additionally, the framework 73 may comprise a plurality of discrete protuberances, as shown in FIGS. 18 and 19. Preferably, the framework 73 comprises a cured polymeric photosensitive resin. The web-contacting surface 71 contacts the web 70 carried thereon. Preferably, the framework 73 defines a predetermined pattern on the web-contacting surface 71. During papermaking, the web-contacting surface 71 preferably imprints the pattern into the web 60. If the preferred essentially continuous network pattern (FIG. 17) is selected for the framework 73, discrete deflection conduits 75 are distributed throughout and encompassed by the framework 73. If the network pattern comprising the discrete protuberances is selected (FIG. 19), the plurality of the deflection conduits comprises an essentially continuous conduit 75, encompassing individual protuberances 73. An embodiment is possible, in which the individual discrete protuberances 73 have discrete conduits 75*a* therein, as shown in FIGS. 18 and 19. The reinforcing structure 74 is primarily disposed between the mutually-opposed surfaces 71 and 72, and may have a surface that is coincidental with the backside surface 72 of the web support 70. The reinforcing structure 74 provides support for the framework 73. The reinforcing structure 74 is typically woven, and the portions of the reinforcing structure 74 registered with the deflection conduits 75 prevent papermaking fibers from passing completely through the deflection conduits 75. If one does not wish to use a woven fabric for the reinforcing structure 74, a non-woven element, such as screen, net, or a plate having a plurality of holes therethrough, may provide adequate strength and support for the framework 73.

The fluid-permeable web support 70 for the use in the present invention may be made according to any of commonly-assigned U.S. Pat. Nos. 4,514,345, issued Apr. 30, 1985, to Johnson et al.; 4,528,239, issued Jul. 9, 1985, to Trokhan; 5,098,522, issued Mar. 24, 1992; 5,260,171, issued Nov. 9, 1993, to Smurkoski et al.; 5,275,700, issued Jan. 4, 1994, to Trokhan; 5,328,565, issued Jul. 12, 1994, to Rasch et al.; 5,334,289, issued Aug. 2, 1994, to Trokhan et al.; 5,431,786, issued Jul. 11, 1995, to Rasch et al.; 5,496,624, issued Mar. 5, 1996, to Stelljes, Jr. et al.; 5,500,277, issued Mar. 19, 1996, to Trokhan et al.; 5,514,523, issued May 7, 1996, to Trokhan et al.; 5,554,467, issued Sept. 10, 1996, to Trokhan et al.; 5,566,724, issued Oct. 22, 1996, to Trokhan et al.; 5,624,790, issued Apr. 29, 1997, to Trokhan et al.; 5,628,876 issued May 13, 1997, to Ayers et al.; 5,679,222 issued Oct. 21, 1997, to Rasch et al.; and 5,714,041 issued Feb. 3, 1998, to Ayers et al., the disclosures of which are incorporated herein by reference. The web support 70 may also comprise a through drying fabric according to U.S. Pat. No. 5,672,248, issued to Wendt et al. on Sep. 30, 1997, and assigned to Kimberly-Clark Worldwide, Inc. of Neenah, Wisconsin, or U.S. Pat. No. 5,429,686, issued to Chiu et al. on Jul. 4, 1995, and assigned to Lindsey Wire, Inc. of Florence, Miss.

The structured webs produced by the current assignee, using the fluid-permeable web supports described above, comprise differential-density regions. Referring to FIGS. 16 and 18, during papermaking such web 60 has two primary portions. A first portion 61 corresponding to and in contact with the framework 73 comprises so-called "knuckles"; and a second portion 62 formed by the fibers deflected into the deflection conduits 74 comprises so-called "pillows." During papermaking, the first portion, which generally corresponds in geometry to the pattern of the framework 73, is imprinted against the framework 73 of the web support 70. In the final web product, the preferred substantially continuous network of the first region (formed from the "knuckles" of first portion 61) is made on the essentially continuous framework 73 of the web support 70. In this instance, the final product's second region (formed from the "pillows" of the second portion 62) comprises a plurality of domes dispersed throughout the imprinted network of the first region and extending therefrom. The domes of the final web product are formed from the pillows, and as such generally correspond in geometry, and during papermaking in position, to the deflection conduits 75 of the web support 70. The web 60 may be made according to any of commonly assigned U.S. Pat. Nos. 4,529,480, issued Jul. 16, 1985, to Trokhan; 4,637,859, issued Jan. 20, 1987, to Trokhan; 5,364,504, issued Nov. 15, 1994, to Smurkoski et al.; and 5,529,664, issued Jun. 25, 1996, to Trokhan et al. and 5,679,222 issued Oct. 21, 1997, to Rasch et al., the disclosures of which are incorporated herein by reference.

Applicant believes, without being bound by theory, that the density of the second portion 62 (i.e., pillows) is lower than the density of the first portion 61 (i.e., knuckles)—due to the fact that the fibers comprising the pillows are deflected into the conduits 75. Moreover, the first region 61 may later be imprinted, for example, against a drying cylinder (such as Yankee drying drum). Such imprinting further increases the density of the first portion 61, relative to that of the second portion 62 of the web 60.

Through-air-drying processes of the prior art are not capable of dewatering both portions 61 and 62 by simply applying air to the web through the web support 70. Typically, at the step of applying air flow to the web, only the second portion 62 can be dewatered by the application of vacuum pressure, while the first portion 61 remains wet. Usually, the first portion 61 is dried by being adhered to and heated by a drying cylinder, such as, for example, the Yankee drying drum.

Now, it is believed that using the process and the apparatus 10 of the present invention, whether or not in combination with the through-air-drying, including application of vacuum pressure, one can simultaneously remove moisture from both the first portion 61 and the second portion 62 of the web 60. Thus, it is believed that the process of the present invention, either alone or in combination with the through-air-drying, can eliminate the application of the drying cylinder as a step in the papermaking process. One of the preferred applications of the process of the present invention, however, is in combination with through-air-drying. It has been found that the apparatus 10 of the present invention may be beneficially used in combination with a vacuum apparatus 43 (FIG. 8, location III), in which instance the web support 70 is preferably fluid-permeable, and more preferably of the type shown in FIGS. 16–19 and described herein above. As used herein, the term "vacuum apparatus" is generic and refers to either one of or both a vacuum pick-up shoe and a vacuum box, well known in the art. It is believed that the oscillatory flow-reversing gas created by the pulse generator 20 and the vacuum pressure created by the vacuum apparatus 43 can beneficially work in cooperation, thereby significantly increasing the efficiency of the combined dewatering process, relative to each of those individual processes. Some of the data pertaining to the combination of the dewatering by the flow-reversing impingement and through-air drying is illustrated in Tables 2–5 below.

Moreover, it has been found that the dewatering characteristics of the oscillatory flow-reversing process is dependent to a significantly lesser degree, if at all, upon the differences in density of the web being dewatered, in comparison with the prior art's conventional processes using a drying cylinder or through-air-drying processes. Therefore, the process of the present invention effectively decouples the water-removal characteristics of the dewatering process—most importantly water-removal rates—from the differences in the relative densities of the differential portions of the web being dewatered. This results in increased equipment capacity and—in turn—increased machine production rates for the differential density web processes.

FIG. 7A partially shows the apparatus 10 comprising a curved web support 70' (for example, the drying cylinder 80) and the gas-distributing system 30 having a plurality of the outlets 39. The web 60 is disposed on the drying cylinder 80 and carried thereon in the machine direction MD. If the web 60 is transferred to the drying cylinder 80 from the web support 70 of the type shown in FIGS. 16–19, as was explained above, the web 60 comprises the knuckles 61 and the pillows 62. The knuckles 61 are in direct contact with (and preferably being adhered to) the drying cylinder 80, while the pillows 62 extend outwardly, due to the geometry of the web support 70, schematically shown in FIGS. 16–19. As a result, air gaps 63 are formed between the pillows 62 and the surface of the drying cylinder 80. These air gaps 63 significantly restrict a heat transfer from the drying cylinder 80 to the pillows 62, thereby preventing effective drying of the pillows 62. The apparatus 10 and the process of the present invention eliminate this problem by being able to impinge the hot oscillatory gas directly onto the web 70, including pillow portions 62. Thus, the apparatus 10 and the process of the present invention create conditions for eliminating through-air-drying step of pillow-drying from the overall papermaking process, thereby potentially reducing costs of the equipment and increasing energy savings.

Figure 7B:
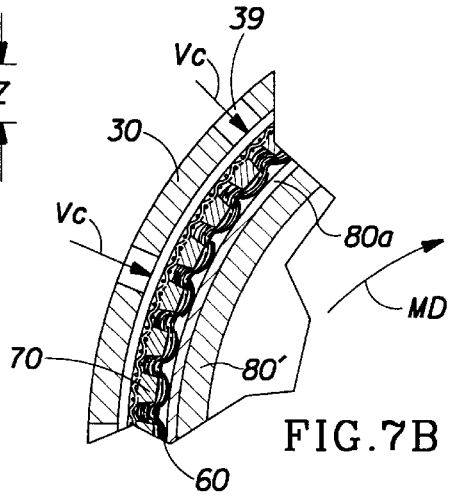
FIG. 7B is a view similar to that shown in FIG. 7A, and showing the web support comprising a fluid-permeable belt, the web being impressed between the web support and the surface of a drying cylinder, the oscillatory flow-reversing gas being applied to the web through the web support.

FIG. 7B shows the web 60 impressed between the drying cylinder 80' and the web support 70 comprising the fluid-permeable papermaking belt, such as, for example, the one shown in FIGS. 16–19. The drying cylinder 80' shown in FIG. 7B is preferably porous. More preferably, the cylinder 80' is covered with a micropore medium 80*a*. This type of the drying cylinder 80' is primarily disclosed in commonly-assigned U.S. Pat. Nos. 5,274,930 issued Jan. 4, 1994; 5,437,107 issued on Aug. 1, 1995; 5,539,996 issued on Jul. 30, 1996; 5,581,906 issued Dec. 10, 1996; 5,584,126 issued Dec. 17, 1996; 5,584,128 issued Dec. 17, 1996; all the foregoing patents are issued to Ensign et al. and are incorporated herein by reference. It is believed that the combination of the oscillatory flow-reversing impingement and the processes described in the foregoing patents may be beneficially used to increase the rates of water removal from the fibrous web 60. In both FIGS. 7A and 7B, directional arrows designated as "Vc" schematically indicate the movement of the oscillatory flow-reversing gas.

It is believed that the superior water-removal rates of the process of the present invention may are attributed to the oscillatory flow-reversing character of the impingement gas. Normally, during water-removing processes of the prior art, the water evaporating from the web forms a boundary layer in a region adjacent to the exposed surface of the web. It is believed that this boundary layer tends to resist to the penetration of the web by impingement gasses. The flow-reversing character of the oscillatory impingement air or gas of the present invention produces a disturbing "scrubbing" effect on the boundary layer of evaporating water, which results in thinning (or "dilution") of the boundary layer. It is believed that this thinning of the boundary layer reduces resistance of the boundary layer to the oscillatory air or gas, and thus allows subsequent cycles of the oscillatory air or gas to penetrate deep into the web. This results in more uniform heating of the web, irrespective of differential density of the web.

Furthermore, the oscillatory field of the flow-reversing gas produced by the Helmholtz-type pulse generator 20 results in high heat flux due to the high convective heat-transfer coefficients of the flow-reversing characteristics of the oscillatory gas. It has been found that not only does the oscillatory flow-reversing field result in high dewatering rates, but rather surprisingly also results in relatively low temperatures of the web surface, compared to the steady-flow impingement of the prior art, under the similar conditions. Not being bound by theory, the applicant believes that the oscillatory flow-reversing nature of the impingement gas produces a very high evaporating cooling effect, due to the mixing of surrounding bulk air onto the drying surface of the web 60. This instantaneously cools the surface of the web 60 and facilitates removal of the boundary layer of the evaporated water. The combination of cyclical application of heat alternating with cyclical surface cooling and "scrubbing" of the boundary layer dramatically enhances the water-removal rates of the process of the present invention, relative to the steady-flow impingement of the prior art, under comparable conditions. Due to this tendency of the web 60 to maintain low web surface temperature relative to the temperature of the oscillatory flow-reversing gas acting upon the web's surface, the temperature of the oscillatory flow-reversing gas can be greatly increased without creating adverse effect on the web 60. Such high temperatures substantially increase water-removal rates, compared to the steady-flow impingement of the prior art. For example, a maximum steady-flow impingement temperatures of about 1000–1200° F. is typically used in commercial high-speed Yankee dryer hoods. The oscillatory flow-reversing gas, in accordance with the present invention, allows one to use the impingement temperatures in excess of 2000° F. without damaging the web 60.

The following TABLE 1 and TABLE 2 show some of the characteristics of the exemplary process and the apparatus 10 of the present invention. In TABLE 1, the parameters of the apparatus 10 are presented. A propane-fired pulse combustor 21, principally shown in FIG. 4, having the following dimensions and operating characteristics was used to evaluate the paper drying rates, in accordance with the present invention.

TABLE 1

| | |
|---|---|
| Cross Sectional Area of Tailpipe | ~0.05 $ft^2$ |
| Combined Length of Tailpipe and Blow Box (L) | 6.19 ft |
| Volume of Tailpipe (Wt) | 0.30 $ft^3$ |
| Volume of Combustion Chamber (Wr) | 0.21 $ft^3$ |
| Frequency (F) | 86 Hz |
| Temperature Inside Combustion Chamber | ~2800° F. |
| Acoustic Pressure Inside Combustion Chamber | (165–179) dB |
| Diameter of Discharge Outlet (D) | 0.25 inch |
| Impingement Area (E) | 1.00 $ft^2$ |
| Ratio ΣA/E | 0.05 |
| Ratio Z/D | 4.0–6.3 |
| Temperature of Gas at Discharge Outlets | (1852–2037)° F. |
| Residence Time | (0.087–0.257) Sec. |

Experiments have been conducted in accordance with an article "An Apparatus For Evaluation Of Web-Heating Technologies—Development, Capabilities, Preliminary Results, and Potential Uses" by Timothy Patterson, et al, published in *TAPPI JOURNAL*, VOL. 79: NO. 3, March 1996. Essentially, a single sheet is propelled at typical industrial paper machine speeds under a heated oscillatory field of the flow-reversing gas, as described herein. This exposes the sheet to approximately the same thermodynamic and aerodynamic conditions that the web would experience in an industrial papermaking process. Water-removal rates are measured based on a difference in the weight of the sheet before and after exposing it to the heated oscillatory flow, for a controlled residence time. The residence time is measured by two photo eyes on the sled, as described in the Patterson et al. reference. The coefficient of variation of the experimental residence time is about 5%.

A wet sheet sample has dimensions eight (8) inches by eight (8) inches. The sheet sample is supported by a 7.5×7.5 inches supporting plate disposed on top of either a mica or screen support. The entire assembly is fastened to a holder on the motorized sled and instrumented for temperature measurements. Thermocouples, mounted on top and bottom of the sheet, are sampled at 1000 Hz/channel by a digital data-acquisition system that is triggered as the sample holder enters a drying zone (i.e., a zone in which the sample is subjected to water removal according to the present invention).

The acoustic pressure P and the frequency F are measured by an acoustic pressure probe, using a Kistler Instrument Company Model 5004 Dual Mode Amplifier and Tektronix Model 453A oscilloscope. The acoustic pressure P is used to calculate the cyclical velocity Vc, as $Vc=P\cdot Gc/dt\cdot C$, where Gc is the gravitational constant, dt is the gas density, and C is the speed of sound, all evaluated at the temperature at the exit from the discharge outlets.

The mean velocity V is calculated from the measured consumption of the fuel by the pulse combustor, assuming no excess air and complete combustion. Actual fuel readings, converted to standard units of cubic feet per hour, are used to calculate the total mass flow of the combustion products. The mean velocity V is then calculated by dividing the mass flow of combustion products by the cross-sectional area of the tailpipe and correcting for exit jet temperature. The fuel used in the pulse combustor 20 ranged from about 165 to about 180 SCFH (Standard Cubic Feet per Hour). The acoustic pressure P inside the combustion chamber 13 in all experiments has been measured to reach about 175 RMS (Root Mean Square) dB.

TABLE 2 summarizes results of several tests conducted in accordance with the present invention. The apparatus 10 has the gas-distributing system 30 comprising the trapezoidal blow box 36 schematically shown in FIG. 14 and described herein above. The concave perforated bottom plate 37 has dimensions 12×12 inches, and thickness of ⅛ inch, and comprised 144 discharge outlets 39 distributed therein in a non-random staggered-array pattern, each outlet 39 having the diameter D of ¼ inch. The discharge outlets provide the angled application of the streams of the oscillatory flow-reversing gas, by virtue of the convex shape of the bottom plate 37. The angles λ range from 90 degrees (of the outlets 39 adjacent to the central axis of the blow box 36) to 42 degrees (of the peripheral outlets 39). The impingement distance Z (column 4) has been designed and computed in accordance with the teachings of the present invention. The web support designated in TABLE 2 as "plate" (column 3) comprises a solid mica plate supporting the wet sample sheet. The "screen" is a 20-mesh screen (having 0.0328-inch clear opening) according to Tyler Standard Screen Scale. Starting fiber consistency (column 5) and basis weight (column 6) are measured using industry standard methods. "Starting" fiber consistency means the fiber consistency measured just before the water-removal tests are conducted according to the present invention. The cyclical velocity Vc (column 7) and the mean velocity V (column 8) are computed according to the procedures previously described. Gas temperature (column 9) is measured by a fast-response time thermocouple at the exit from the discharge outlets 39. Residence time (column 10) is measured as described herein above.

Adjustments are made for handling losses. A control test is run for each experimental condition, with no oscillatory flow impingement, to determine experimental water losses due to sample handling and propelling the sample on the motorized sled. Water-removal rates (column 11) are calculated by subtracting the control-run weight change from the experimental weight change, and then dividing the result by the web area and the residence time, as one skilled in the art will appreciate. The coefficient of variation of the experimental rates of water-removal is about 15%. For every Example (column 1) several trials (column 2) are conducted, and the results are averaged, according to customary methods known in the art.

TABLE 2

| | | | 4 | Web | | 7 | 8 | | | |
|---|---|---|---|---|---|---|---|---|---|---|
| 1 Example | 2 Number of Trials | 3 Web Support | Impingement Distance Z (inch) | Starting Fiber-Consistency (%) | Basis Weight (gsm) | Cyclical Velocity Vc (ft/min) | Mean Velocity V (ft/min) | 9 Gas Temp. (° F.) | 10 Residence Time (sec) | 11 Water-Removal Rate (lb/hrft$^2$) |
| 1 | 8 | plate | 1.2 | 28 | 21 | 23400 | 4900 | 1852 | 0.102 | 39.9 |
| 2 | 6 | plate | 1.2 | 35 | 21 | 23400 | 4800 | 1874 | 0.219 | 47.4 |
| 3 | 5 | plate | 1.2 | 45 | 21 | 23700 | 5900 | 1987 | 0.109 | 45.2 |
| 4 | 5 | plate | 1.2 | 28 | 21 | 28000 | 7100 | 2004 | 0.125 | 63.0 |
| 5 | 6 | plate | 1.6 | 28 | 205 | 28000 | 7200 | 2002 | 0.132 | 59.3 |
| 6 | 5 | plate | 1.2 | 28 | 21 | 25800 | 6700 | 1977 | 0.127 | 51.3 |
| 7 | 7 | screen | 1.2 | 28 | 21 | 23600 | 5500 | 1964 | 0.123 | 63.1 |
| 8 | 6 | screen | 1.2 | 28 | 21 | 23600 | 5800 | 1938 | 0.257 | 50.9 |
| 9 | 4 | screen | 1.2 | 35 | 21 | 23600 | 5800 | 1945 | 0.124 | 70.8 |
| 10 | 3 | screen | 1.2 | 45 | 21 | 23500 | 5500 | 1925 | 0.107 | 71.0 |

TABLE 3 (arranged similarly to TABLE 2)shows data pertaining to the gas-distributing system 30 comprising the blow box 36 having the convex bottom plate 37, schematically shown in FIG. 12. As TABLE 2 and TABLE 3 show, the dewatering rates (columns 11) achieved with the blow box 36 having the convex bottom plate 37 are significantly higher than those achieved with the blow box 36 having the planar bottom plate 37, even though the residence time relevant to the planar-bottom blow box 36 is generally greater than that relevant to the convex-bottom blow box 36. For example comparison of Example 2 in TABLE 2 with Examples 8 and 11 in TABLE 3 shows that the drying rate in TABLE 3 is about twice as high as that in TABLE 2, even though the impingement distance Z and the residence time appear to benefit the dewatering rate in TABLE 2, while the gas temperature and the mean velocity V appear to benefit the dewatering rates in TABLE 3. Rather surprisingly, the paper web samples dried/dewatered under the conditions shown in TABLE 2 and TABLE 3 showed no evidence of scorching or discoloration. This was unexpected given the high temperature of the oscillatory impingement gas used in the present invention and prior art's limitations on the through-air drying and steady-flow impingement gas temperature.

TABLE 3

| | | | 4 | Web | | 7 | 8 | | | |
|---|---|---|---|---|---|---|---|---|---|---|
| 1 Example | 2 Number of Trials | 3 Web Support | Impingement Distance Z (inch) | Starting Fiber-Consistency (%) | Basis Weight (gsm) | Cyclical Velocity Vc (ft/min) | Mean Velocity V (ft/min) | 9 Gas Temp. (° F.) | 10 Residence Time (sec) | 11 Water-Removal Rate (lb/hr ft$^2$) |
| 1 | 7 | plate | 1.0 | 28 | 21 | 23600 | 7000 | 1977 | 0.090 | 96.8 |
| 2 | 6 | plate | 1.0 | 28 | 21 | 23600 | 7200 | 1949 | 0.087 | 88.5 |
| 3 | 7 | plate | 1.3 | 28 | 21 | 23600 | 7200 | 1933 | 0.089 | 81.9 |
| 4 | 7 | plate | 1.0 | 28 | 45 | 23700 | 7400 | 1984 | 0.097 | 113.7 |
| 5 | 5 | plate | 1.3 | 35 | 45 | 23700 | 6900 | 2016 | 0.098 | 104.5 |
| 6 | 6 | plate | 1.0 | 35 | 21 | 23700 | 7200 | 1987 | 0.087 | 103.2 |
| 7 | 6 | plate | 1.0 | 35 | 21 | 23700 | 7200 | 1988 | 0.092 | 110.9 |
| 8 | 7 | plate | 1.3 | 35 | 21 | 23600 | 7200 | 1955 | 0.093 | 102.0 |
| 9 | 5 | screen | 1.0 | 35 | 21 | 23700 | 7400 | 2011 | 0.091 | 126.0 |
| 10 | 5 | plate | 1.0 | 35 | 21 | 23800 | 7500 | 2037 | 0.093 | 127.3 |
| 11 | 7 | plate | 1.3 | 35 | 21 | 23600 | 6900 | 1954 | 0.099 | 98.8 |
| 12 | 5 | screen | 1.0 | 35 | 21 | 23600 | 7600 | 1966 | 0.104 | 128.1 |

For comparison, TABLE 5 shows results of the experiments conducted using the apparatus 10 comprising the gas-distributing system 30 having a single tailpipe 15 split into sixty-four individual tubes extending therefrom, each having the discharge outlet 39. These sixty-four tubes are equally divided into two pluralities of the discharge outlets 39 to define two separate consecutive impingement areas, each having dimensions 5×12 inches. Each of the pluralities of the discharge outlets 39 comprises a non-random staggered array. Three exhaust regions alternate with the impingement areas. The total area of the exhaust regions is 14×12 inches. Each outlet 39 has the diameter D of 0.375 inches. Both the tailpipe 15 and the individual tubes are air-cooled to reduce the temperature of the gas at exit from the discharge outlets 39. Further details of the experimental apparatus are given in TABLE 4.

TABLE 4

| | |
|---|---|
| Cross Sectional Area of Tailpipe | ~0.05 ft$^2$ |
| Combined Length of Tailpipe and Tube (L) | 6.19 ft |
| Volume of Tailpipe (Wt) | 0.30 ft$^3$ |
| Volume of Combustion Chamber (Wr) | 0.21 ft$^3$ |
| Frequency (F) | 86 Hz |
| Temperature Inside Combustion Chamber | ~2800° F. |
| Acoustic Pressure Inside Combustion Chamber | (165–174) dB |
| Diameter of Discharge Outlet (D) | 0.375 inch |
| Impingement Area (E) | 0.83 ft$^2$ |
| Ratio ΣA/E | 0.025 |
| Ratio Z/D | 2.7–4.0 |
| Temperature of Gas at Discharge Outlets | (698–1116)° F. |
| Residence Time | (0.161–0.738) Sec. |

TABLE 5

| 1 Example | 2 Number of Trials | 3 Web Support | 4 Impingement Distance Z (inch) | Web Starting Fiber-Consistency (%) | Web Basis Weight (gsm) | 7 Cyclical Velocity Vc (ft/min) | 8 Mean Velocity V (ft/min) | 9 Gas Temp. (° F.) | 10 Residence Time (sec) | 11 Water-Removal Rate (lb./hr ft$^2$) |
|---|---|---|---|---|---|---|---|---|---|---|
| 1 | 5 | Plate | 1.5 | 28 | 21 | 11000 | 3200 | 700 | 0.172 | 24.7 |
| 2 | 6 | Plate | 1.5 | 28 | 21 | 6900 | 1900 | 698 | 0.179 | 26.4 |
| 3 | 5 | Plate | 1.5 | 28 | 21 | 7400 | 2000 | 892 | 0.176 | 32.4 |
| 4 | 6 | Plate | 1.5 | 28 | 21 | 14100 | 3500 | 888 | 0.182 | 43.7 |
| 5 | 6 | Plate | 1.5 | 28 | 21 | 14100 | 4100 | 1049 | 0.171 | 61.4 |
| 6 | 8 | Plate | 1.0 | 28 | 21 | 15900 | 4100 | 1106 | 0.272 | 46.6 |
| 7 | 10 | Plate | 1.0 | 28 | 21 | 15900 | 3900 | 1107 | 0.513 | 50.6 |
| 8 | 7 | Plate | 1.0 | 28 | 21 | 15800 | 4300 | 1072 | 0.738 | 50.4 |
| 9 | 10 | Plate | 1.0 | 45 | 21 | 15100 | 4400 | 1091 | 0.416 | 58.8 |
| 10 | 6 | Plate | 1.0 | 28 | 42 | 15100 | 4600 | 1100 | 0.161 | 81.8 |
| 11 | 7 | Plate | 1.0 | 28 | 21 | 15100 | 4400 | 1090 | 0.346 | 69.4 |
| 12 | 7 | Screen | 1.0 | 28 | 21 | 15100 | 4500 | 1091 | 0.164 | 100.6 |
| 13 | 6 | Screen | 1.0 | 28 | 21 | 15200 | 4300 | 1117 | 0.530 | 75.8 |
| 14 | 8 | Plate | 1.0 | 28 | 21 | 15900 | 4100 | 1106 | 0.503 | 46.6 |
| 15 | 6 | Plate | 1.0 | 28 | 21 | 15200 | 4100 | 1113 | 0.207 | 63.6 |
| 16 | 6 | Plate | 1.0 | 28 | 21 | 15200 | 3900 | 1116 | 0.341 | 65.3 |
| 17 | 8 | Plate | 1.0 | 28 | 21 | 15900 | 4100 | 1106 | 0.272 | 46.6 |

As has been explained above, it is believed that the oscillatory flow-reversing gases are impinged upon the web 60 on the positive cycles and pulled away from the web 60 on the negative cycles thereby carrying away moisture contained in the web 60. The moisture pulled away from the web 60 typically accumulates in the boundary layer adjacent to the surface of the web 60. Therefore, it may be desirable to reduce, or even prevent, build-up of humidity in the boundary layer and the area adjacent thereto. In accordance with the present invention, therefore, the apparatus 10 may have an auxiliary means 40 for removing moisture from the impingement region including the boundary layer, and an area surrounding the impingement region. In FIG. 1, such auxiliary means 40 shown as comprising slots 42 in fluid communication with an outside area having the atmospheric pressure. Alternatively or additionally, the auxiliary means 40 may comprise a vacuum source 41. In the latter instance, the vacuum slots 42 may extend from the impingement region and/or an area adjacent to the impingement region to the vacuum source 41, thereby providing fluid communication therebetween.

The process of the present invention can be used in combination with application of ultrasonic energy. The application of the ultrasonic energy is described in a commonly-assigned patent application Ser. No. 09/065,655, filed on Apr. 23, 1998, in the names of Trokhan and Senapati, which application is incorporated by reference herein.

What is claimed is:

1. A process for removing water from a fibrous web, which process comprises the following steps:

(a) providing a fibrous web having a moisture content from about 10% to about 90%;

(b) providing an oscillatory flow-reversing gas having a predetermined frequency;

(c) providing a gas-distributing system designed to deliver the oscillatory flow-reversing gas onto a predetermined portion of the web and comprising a plurality of discharge outlets; and (d) impinging the oscillatory flow-reversing gas onto the web through the plurality of discharge outlets, thereby removing moisture from the web.

2. The process according to claim 1, wherein in the step (d) the oscillatory flow-reversing gas is impinged onto the web in a predetermined pattern defining an impingement area of the web.

3. The process according to claim 2, wherein the oscillatory flow-reversing gas is impinged onto the web such as to provide a substantially even distribution of the oscillatory flow-reversing gas throughout the impingement area of the web.

4. The process according to claim 3, wherein the oscillatory flow-reversing gas is impinged onto the web through the plurality of the discharge outlets comprising a non-random and staggered array.

5. The process according to claim 2, wherein the oscillatory flow-reversing gas is impinged onto the web such as to provide an uneven distribution of the oscillatory flow-reversing gas throughout the impingement area of the web, thereby allowing control of moisture profiles of the web.

6. The process according to claim 1, wherein in the step (d) each of the plurality of the discharge outlets emits a stream of the oscillatory flow-reversing impingement gas having oscillating sequence of positive cycles and negative cycles at a frequency from about 15 Hz to about 1500 Hz, the positive cycles having a positive amplitude and the negative cycles having a negative amplitude less than the positive amplitude, the impingement gas further having a cyclical velocity, the cyclical velocity comprising a positive velocity directed in a positive direction towards the web during the positive cycles, and a negative velocity directed in a negative direction opposite to the positive direction during the negative cycles, the positive velocity being greater than the negative velocity.

7. The process according to claim 6, wherein the positive direction of at least some of the streams of the impingement gas and a surface of the impingement area of the web form acute angles therebetween.

8. The process according to claim 1, wherein in the step (d) the oscillatory flow-reversing gas has a temperature from about 500° F. to about 2500° F. when exiting the discharge outlets.

9. The process according to claim 6, wherein the cyclical velocity of the oscillatory flow-reversing impingement gas is from about 1000 ft/min to about 50000 ft/min when exiting the discharge outlets.

10. The process according to claim 6, wherein the oscillatory flow-reversing gas at least partially penetrate the web during the positive cycles and pull the water from the web and an area adjacent thereto during the negative cycles.

11. A process for removing water from a fibrous web, which process comprises the following steps:

(a) providing a fibrous web having a moisture content from about 10% to about 90% and supported by a web support having a machine direction and a cross-machine direction perpendicular to the machine direction, the web support further having a web-contacting surface associated with the fibrous web and a backside surface opposite to the web-contacting surface;

(b) providing a means for moving the web support having the web thereon in the machine direction;

(c) providing a pulse generator designed to produce and discharge oscillatory flow-reversing gas having a frequency from about 15 Hz to about 1500 Hz;

(d) providing a gas-distributing system in fluid communication with the pulse generator and terminating with a plurality of discharge outlets, each of the discharge outlets having an equivalent diameter D and an open area through which the oscillatory flow-reversing impingement gas is discharged, the plurality of the discharge outlets having a resulting open area;

(e) disposing the web support having the web thereon at a predetermined impingement distance Z from the plurality of the discharge outlets, thereby defining an impingement region between the discharge outlets and the web support, a pattern of the discharge outlets further defining an impingement area of the web, corresponding thereto, the resulting open area of the plurality of the discharge outlets comprising from about 0.5% to about 20% of the impingement area, and a ratio Z/D comprising from 1 to 10;

(f) moving the web support having the web thereon in the machine direction at a velocity from 100 feet per minute to 10,000 feet per minute; and (g) operating the pulse generator and impinging the oscillatory flow-reversing gas through the discharge outlets onto the web, thereby removing the moisture therefrom.

12.The process according to claim 11, wherein in the step (a) the web support comprises a fluid-permeable endless belt or band.

13. The process according to claim 12, wherein the web support comprises a framework and at least one fluid-permeable conduit extending between the web-contacting surface and the backside surface of the web support.

14. The process according to claim 13, wherein the framework comprises a substantially continuous structure forming a substantially continuous network comprising the web-contacting surface of the web support, and the at least one conduit comprises a plurality of discrete conduits encompassed by the framework.

15. The process according to claim 11, wherein in the step (a) the web support comprises a surface of a drying cylinder.

16. The process according to claim 11, further comprising a step of providing an auxiliary means for removing the moisture from the impingement region between the discharge outlets and the web support.

17. The process according to claim 16, wherein the auxiliary means comprises a vacuum source and at least one vacuum slot extending from the vacuum source to the impingement region, thereby providing a fluid communication therebetween.

18. The process according to claim 11, further comprising the steps of providing a means for generating a non-oscillatory and substantially steady-flow impingement gas and impinging the non-oscillatory gas onto the web.

19. The process according to claim 18, wherein in the step (e) the oscillatory flow-reversing gas and the non-oscillatory gas are impinged onto the impingement area of the web sequentially.

20. The process according to claim 11, further comprising steps of providing a vacuum apparatus, juxtaposing the vacuum apparatus with the backside surface of the web support, and operating the vacuum apparatus thereby removing the moisture from the web through the fluid-permeable web support.

21. A process for removing water from a differential-density fibrous web, which process comprises the following steps:

(a) providing a structured fibrous web comprising a plurality of low-density micro-regions and a plurality of high-density micro-regions, and having a moisture content from about 10% to about 90%, the web being supported by a fluid-pervious web support having a machine direction and a cross-machine direction perpendicular to the machine direction, and comprising a reinforcing structure joined to a substantially continuous framework, the framework forming a web-contacting surface associated with the web, a backside surface opposite to the web-contacting surface, and a plurality of fluid-permeable conduits encompassed by the framework and extending from the web-contacting surface to the backside surface;

(b) providing a means for moving the web support having the web thereon in the machine direction;

(c) providing a pulse generator designed to produce and discharge oscillatory flow-reversing impingement gas having a frequency from about 15 Hz to about 1500 Hz;

(d) providing a gas-distributing system in fluid communication with the pulse generator and terminating with a plurality of discharge outlets comprising a predetermined pattern designed to provide a substantially even distribution of the oscillatory flow-reversing impingement gas in the cross-machine direction;

(e) disposing the web support having the web thereon at a predetermined impingement distance from the plurality of the discharge outlets, thereby defining an impingement region between the discharge outlets and the web-contacting surface of the web support, the pattern of the discharge outlets defining an impingement area of the web corresponding thereto;

(f) moving the web support having the web thereon in the machine direction; and (g) operating the pulse generator and impinging the oscillatory flow-reversing impingement gas through the discharge outlets onto the web, thereby removing the moisture from the web.

22.The process according to claim 21, further comprising steps of providing a vacuum apparatus and juxtaposing the vacuum apparatus with the backside of the web support in the area at least partially corresponding to the impingement area of the web, the vacuum apparatus being designed to apply a vacuum pressure to the web through the conduits of the web support, and a step of applying the vacuum pressure to the web, thereby removing the moisture therefrom.

* * * * *